US010816016B2

(12) United States Patent
Arai

(10) Patent No.: US 10,816,016 B2
(45) Date of Patent: Oct. 27, 2020

(54) THRUST EXPANSION DEVICE

(71) Applicant: Seiko Instruments Inc., Chiba-shi, Chiba (JP)

(72) Inventor: Shigehiro Arai, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 16/656,023

(22) Filed: Oct. 17, 2019

(65) Prior Publication Data

US 2020/0132090 A1 Apr. 30, 2020

(30) Foreign Application Priority Data

Oct. 31, 2018 (JP) ..... 2018-205020
Sep. 26, 2019 (JP) ..... 2019-175375

(51) Int. Cl.
*F15B 9/02* (2006.01)
*F15B 3/00* (2006.01)

(52) U.S. Cl.
CPC . *F15B 9/02* (2013.01); *F15B 3/00* (2013.01)

(58) Field of Classification Search
CPC ..... F15B 3/00; F15B 11/032; F15B 11/0325; F15B 11/072; F15B 11/0725
See application file for complete search history.

(56) References Cited

U.S. PATENT DOCUMENTS 3,038,313 A * 6/1962 Trythall ..... F15B 3/00 60/560
4,300,351 A * 11/1981 Grullmeier ..... B30B 15/165 60/560
5,125,234 A * 6/1992 Yonezawa ..... F15B 11/0325 409/233
5,247,870 A * 9/1993 Brasca ..... B30B 15/165 60/560
5,247,871 A * 9/1993 Brasca ..... B30B 15/165 60/560
5,297,382 A * 3/1994 Waltonen ..... F15B 11/0325 60/533
5,582,009 A * 12/1996 Brieschke ..... F15B 3/00 60/560
5,649,424 A * 7/1997 Valavaara ..... F15B 3/00 60/560

(Continued)

FOREIGN PATENT DOCUMENTS

JP 4895342 B2 3/2012

*Primary Examiner* — Michael Leslie
(74) *Attorney, Agent, or Firm* — Brinks Gilson & Lione

(57) ABSTRACT

A through-hole of a hydraulic chamber is provided on an input side of a thrust expansion device in accordance with rod diameters of various actuators on the input side, and an input rod of an air cylinder or the like is inserted therein. Thus, a thrust expansion mechanism operates. An input-side actuator attaching portion of the thrust expansion device is configured such that parts can be changed according to a fixing method of various actuators and a rod shape. It is possible to freely change a thrust expansion ratio by changing a cross sectional area of the input rod. A stroke of an output-side rod can be changed by changing an input stroke of the input-side actuator. According to the thrust expansion device, various inexpensive commercially available actuators can be easily attached and replaced by being separated and independent from the input-side actuator.

23 Claims, 12 Drawing Sheets

(56) References Cited

U.S. PATENT DOCUMENTS

| | | | | |
|---|---|---|---|---|
| 6,012,287 | A * | 1/2000 | Sims | F15B 11/0325 60/560 |
| 6,735,944 | B2 * | 5/2004 | Sawdon | B21J 15/22 60/560 |
| 8,973,360 | B2 * | 3/2015 | Wu | F15B 3/00 60/565 |
| 2013/0098238 | A1 * | 4/2013 | Wu | F15B 11/0725 92/53 |
| 2018/0172029 | A1 * | 6/2018 | Arai | F15B 11/0325 |
| 2020/0096014 | A1 * | 3/2020 | Arai | F15B 9/16 |
| 2020/0132089 | A1 * | 4/2020 | Arai | F15B 3/00 |

* cited by examiner (1) CAULKING (2) DRILLING (3) PRESSING

THRUST EXPANSION DEVICE

RELATED APPLICATIONS

This application claims priority to Japanese Patent Application Nos. 2018-205020, filed on Oct. 31, 2018 and 2019-175375 filed Sep. 26, 2019, the entire content of which is incorporated herein by reference.

BACKGROUND OF THE INVENTION

1. Field of the Invention

The present invention relates to a thrust expansion device, and more particularly to a thrust expansion device that outputs an input pressure as an amplified thrust.

2. Description of the Related Art

A fluid pressure cylinder using a fluid such as air (gas) or oil (liquid) is used in many industrial fields.

The fluid pressure cylinder generates a thrust on a piston in a cylinder due to a pressure of a fluid such that the thrust can be a drive force of various types of mechanical actuation such as driving of a press or an actuator.

As such a fluid pressure cylinder, there is an air hydraulic cylinder that converts a pneumatic pressure to a hydraulic pressure inside the cylinder (Japanese Patent No. 4895342).

In the air hydraulic cylinder, the air cylinder (input side) and the hydraulic cylinder (output side) that expands the thrust are combined into a single cylinder, and an air piston that is driven by air is disposed on the input side in the cylinder. The hydraulic piston and an output rod that are driven by using, as an input, the output of the air piston are disposed on the output side.

However, in the air hydraulic cylinder described in Japanese Patent No. 4895342, since an input-side air cylinder unit and an output-side hydraulic cylinder unit (thrust expansion mechanism unit) are integrally formed, the output of the air cylinder unit, a size of the air cylinder, a stroke, and the like are fixed.

Therefore, in a case in which it is necessary to change the stroke of a different air cylinder unit or the like, it is not easy to replace only the air cylinder unit, so that it is necessary to replace the entire air hydraulic cylinder in practice.

SUMMARY OF THE INVENTION

According to an aspect of the invention, an object thereof is to make it possible to easily fix and replace an input-side actuator.

(1) According to a first aspect of the invention, there is provided a thrust expansion device that expands and outputs a thrust input from an input actuator by connecting the input actuator to an input side, the device including a cylinder; a fluid piston having a piston portion disposed in the cylinder and moving in a thrust direction in the cylinder, and an output rod connected to the piston portion; an output-side lid portion connected to one end side of the cylinder and provided with a through-hole in which the output rod moves in the thrust direction; an input-side lid portion connected to the other end side of the cylinder and provided with an input portion to which the thrust from the input actuator is input; fluid supply means for supplying a fluid into a fluid chamber partitioned by the cylinder, the piston portion, and the input-side lid portion; and fixing means for fixing the input actuator, which is disposed at least one location of the cylinder, the output-side lid portion, and the input-side lid portion.

(2) According to a second aspect of the invention, in the thrust expansion device of the first aspect, the input-side lid portion includes an input-side lid where a replacing input portion is formed at a center, and which is fixed to the cylinder, and a lid adaptor where the input portion is formed at a center, and which is disposed in the replacing input portion of the input-side lid, and is fixed in a replaceable manner.

(3) According to a third aspect of the invention, in the thrust expansion device of the first or second aspect, the fixing means includes fixing bolt holes formed in the input-side lid portion.

(4) According to a fourth aspect of the invention, in the thrust expansion device of the first, second, or third aspect, the fixing means includes fixing bolt holes formed on side surfaces of the input-side lid portion and the output-side lid portion.

(5) According to a fifth aspect of the invention, in the thrust expansion device of any one of the first to fourth aspects, the fluid piston includes a bottomed cavity portion extending from the piston portion to a middle of the output rod and forming a part of the fluid chamber.

(6) According to a sixth aspect of the invention, in the thrust expansion device of any one of the first to fifth aspects, the fixing means includes a bolt hole for fixing a fixing adaptor for fixing the input actuator via the fixing adaptor.

(7) According to a seventh aspect of the invention, in the thrust expansion device of the sixth aspect, the fixing means fixes the input actuator, at a position spaced apart from the input-side lid by a predetermined distance via the fixing adaptor.

(8) According to an eighth aspect of the invention, in the thrust expansion device of the seventh aspect, the fixing means fixes the input actuator where an adaptor rod is fixed to a front end of an input rod of the input actuator, at a position spaced apart by the predetermined distance via the fixing adaptor.

(9) According to a ninth aspect of the invention, in the thrust expansion device of the eighth aspect, the input portion formed on the input-side lid portion has a circular shape that matches a cross sectional shape of the adaptor rod fixed to the front end of the input actuator.

(10) According to a tenth aspect of the invention, in the thrust expansion device of any one of the first to seventh aspects, the input portion formed on the input-side lid portion has a circular shape that matches a cross sectional shape of an input rod of the input actuator.

(11) According to an eleventh aspect of the invention, in the thrust expansion device of any one of the first to tenth aspects, the input actuator to be fixed by the fixing means is an air cylinder or an electric cylinder.

(12) According to a twelfth aspect of the invention, in the thrust expansion device of the eleventh aspect, an input rod of the input actuator has a circular cross sectional shape with no level difference on an outer circumferential surface thereof.

(13) According to a thirteenth aspect of the invention, in the thrust expansion device of any one of the first to twelfth aspects, the output-side lid portion has a rotation stop member that restricts rotation of the piston with respect to the output-side lid portion.

(14) According to a fourteenth aspect of the invention, in the thrust expansion device of any one of the first to thirteenth aspects, the thrust expansion device further includes biasing means for applying a force to the fluid piston in a direction toward the input side.

(15) According to a fifteenth aspect of the invention, in the thrust expansion device of any one of the first to fourteenth aspects, the output-side lid portion includes an output-side lid where a replacing output portion is formed at a center and which is fixed to the cylinder, and a stop lid where the through-hole is formed at a center and which is disposed on the replacing output portion of the output-side lid and is fixed in a replaceable manner.

(16) According to a sixteenth aspect of the invention, in the thrust expansion device of the fifteenth aspect, the thrust expansion device further includes output fixing means for fixing an output attachment, disposed at least one location of the cylinder, the output-side lid portion, and the input-side lid portion, and receiving an expanded thrust output from the output rod.

(17) According to a seventeenth aspect of the invention, in the thrust expansion device of the sixteenth aspect, the thrust expansion device further includes the output attachment capable of replacing a working jig corresponding to a working step.

(18) According to an eighteenth aspect of the invention, in the thrust expansion device of the sixteenth aspect, the thrust expansion device further includes the output attachment capable of replacing gripping means for gripping a workpiece according to a workpiece shape.

(19) According to a nineteenth aspect of the invention, in the thrust expansion device of any one of the fifteenth to eighteenth aspects, the thrust expansion device further includes robot fixing means for fixing a robot adaptor for attaching a robot arm, which is disposed at least one location of the cylinder, the output-side lid portion, and the input-side lid portion.

(20) According to a twentieth aspect of the invention, in the thrust expansion device of any one of the first to nineteenth aspects, the fixing means fixes the input actuator so that an axis of an input rod of the input actuator that inputs a thrust to the input portion has a predetermined inclination angle with respect to an axis of the output rod.

(21) According to a twenty-first aspect of the invention, in the thrust expansion device of the twentieth aspect, the input-side lid portion is connected to the cylinder at the predetermined inclination angle with respect to the output-side lid portion.

(22) According to a twenty-second aspect of the invention, in the thrust expansion device of the twentieth or twenty-first aspect, the inclination angle is 90 degrees.

(23) According to a twenty-third aspect of the invention, there is provided a thrust expansion device including an input actuator having a cylindrical input rod; a cylinder; a fluid piston having a piston portion disposed in the cylinder and moving in a thrust direction in the cylinder, and an output rod connected to the piston portion; an output-side lid portion connected to one end side of the cylinder and provided with a through-hole in which the output rod moves in the thrust direction; an input-side lid portion connected to the other end side of the cylinder and provided with an input portion to which the thrust from the input actuator is input; fluid supply means for supplying a fluid into a fluid chamber partitioned by the cylinder, the piston portion, and the input-side lid portion; and fixing means for fixing the input actuator, which is disposed at least one location of the cylinder, the output-side lid portion, and the input-side lid portion. The input actuator is connected by inserting the input rod through the input-side lid portion to expand and output the thrust input from the input actuator.

According to the present invention, since the fixing means for fixing the input actuator to at least one location of the cylinder, the output-side lid portion, and the input-side lid portion is provided, various input-side actuators can be easily fixed and replaced.

DETAILED DESCRIPTION OF THE PREFERRED EMBODIMENTS

(1) Outline of Embodiment

In a thrust expansion device 1 of the present embodiment, a portion constituting a thrust expansion function is separated from a so-called air hydraulic cylinder, which has an input function of inputting a thrust that is a source of the thrust to be output, and a thrust expansion function of expanding and outputting the input thrust as a fluid pressure using a Pascal's principle, and is formed independently.

The thrust expansion device 1 does not operate alone because there is no input in the device itself, and can be operated by assembling various input-side actuators directly or via an adaptor in order to obtain the thrust (input) to be expanded.

Specifically, an input port (through-hole 41) of a fluid chamber (hydraulic chamber 8) that matches rod diameters of various actuators on the input side is provided on the input side of the thrust expansion device 1, a rod (input rod 101 or the like) of the input-side actuator is inserted into the input port, and thereby a thrust expansion mechanism operates.

An input-side actuator attaching portion of the thrust expansion device 1 is configured such that parts can be changed according to a fixing method of various actuators and a rod shape. It is possible to freely change a thrust expansion ratio by changing a cross sectional area of the input rod. A stroke of the output-side rod can be changed by changing an input stroke of the input-side actuator.

According to the thrust expansion device 1, various commonly used cylinders can be easily attached and replaced by being separated and independent from the input-side actuator.

(2) Details of Embodiment

Figure 1C:
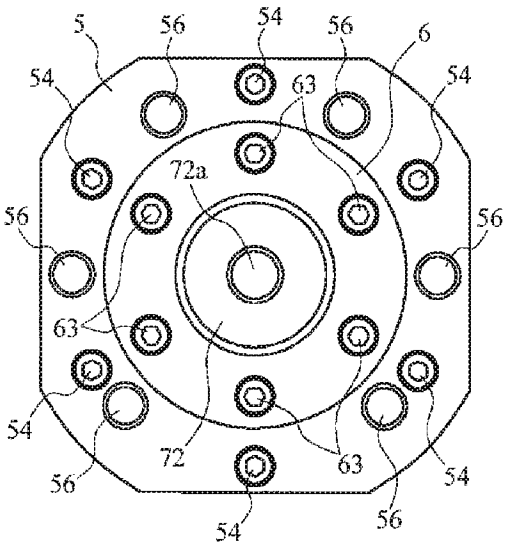
FIGS. 1A to 1C are sectional views and side views for explaining a thrust expansion device.
Figure 1A:
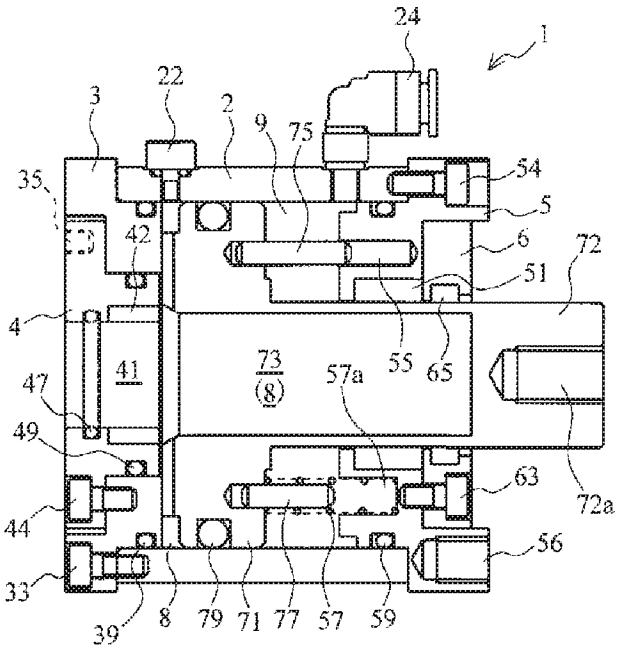
Figure 1B:
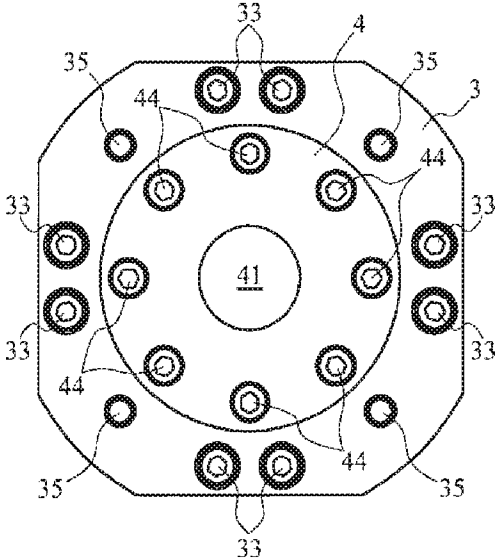

FIGS. 1A to 1C illustrate a configuration of the thrust expansion device 1 according to the present embodiment, in which FIG. 1A illustrates a cross section in a thrust direction (direction of a centerline), FIG. 1B illustrates a side surface from a left side, and FIG. 1C illustrates a side surface from a right side.

Figure 2:
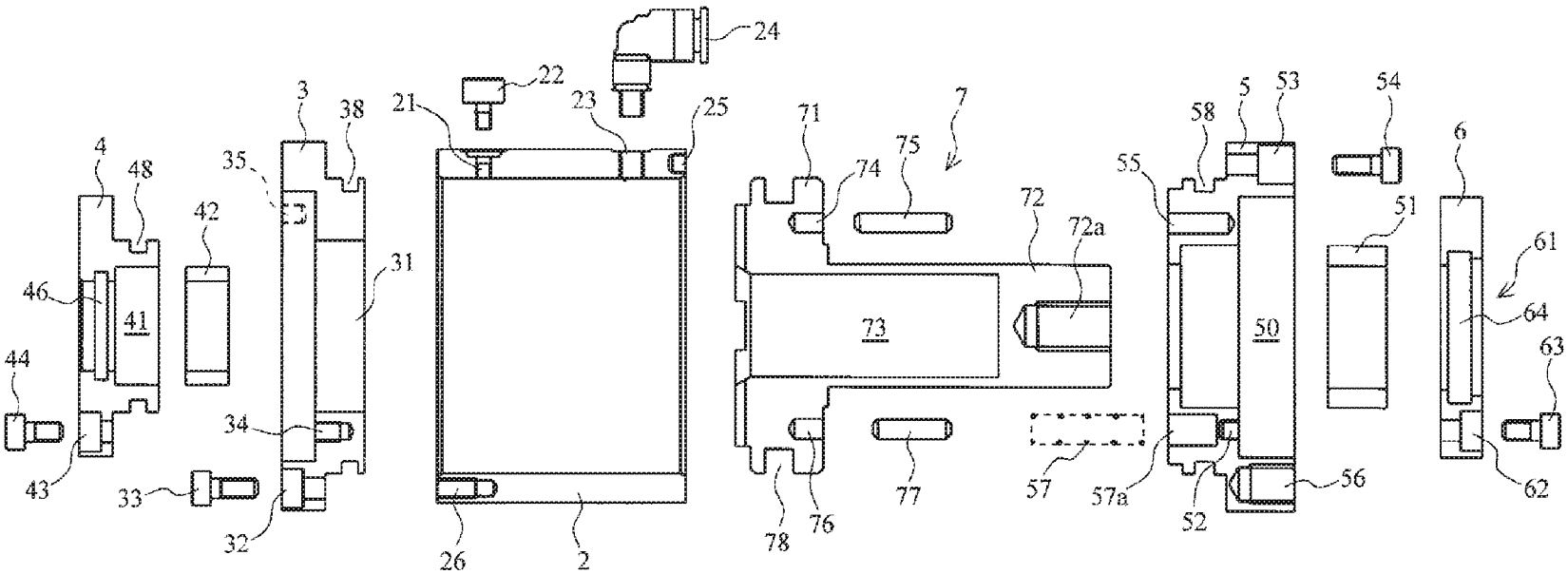
FIG. 2 is a view of parts of the thrust expansion device.

FIG. 2 illustrates each part constituting the thrust expansion device 1. However, an O-ring illustrated in FIGS. 1A to 1C is not illustrated in FIG. 2.

In all the drawings, the thrust output from the thrust expansion device 1 is described in an output direction from the left side to the right side of the drawings. Therefore, the left side of the drawing is referred to as the input side and the right side is referred to as the output side.

As illustrated in FIGS. 1A to 2, the thrust expansion device 1 includes a cylinder 2 that forms a part (circumferential surface) of a hydraulic chamber.

An input-side lid 3 is fixed to an end portion of the cylinder 2 on the input side, and a lid adaptor 4 that can be replaced according to the input-side actuator to be used is attached to a center of the input-side lid 3. The input-side lid 3 and the lid adaptor 4 function as an input-side lid portion.

On the other hand, an output-side lid 5 is fixed to an end portion of the cylinder 2 on the output side, and a stop lid 6 is attached to a center of the output-side lid 5.

A hydraulic piston 7 (fluid piston), which forms a part (one end surface in the thrust direction) of the hydraulic chamber and outputs an expanded thrust, is disposed inside the cylinder 2.

A material of parts (excluding specific parts such as an O-ring and a sliding assistant ring) constituting the thrust expansion device 1 of the present embodiment is a metal such as aluminum, stainless steel, or iron.

As an example, the thrust expansion device 1 has sizes in which an outer diameter is about 70 mm and a stroke length of the output rod 72 is about 5 mm, however, the sizes may be larger or smaller than those described above.

Hereinafter, each of the cylinder 2, the input-side lid 3, the lid adaptor 4, the output-side lid 5, the stop lid 6, and the hydraulic piston 7 will be described.

The cylinder 2 is formed in a cylindrical shape of which both end surfaces are open, a screw hole 25 is formed at the open end on the output side, and a screw hole 26 is formed at the open end on the input side.

The screw hole 25 is a screw hole for fixing the output-side lid 5 by a pressing bolt 54, and female screws are formed inside. Screw holes 25 are formed at six locations on the same circumference corresponding to positions of the pressing bolts 54 illustrated in FIG. 1C.

The screw hole 26 is a screw hole for fixing the input-side lid 3 by a pressing bolt 33, and female screws are formed inside. Screw holes 26 are formed at eight locations on the same circumference corresponding to positions of the pressing bolts 33 illustrated in FIG. 1A.

An oil filler 21 and an inlet/outlet hole 23 penetrate a cylindrical surface of the cylinder 2.

The oil filler 21 is a through-hole for supplying oil into the hydraulic chamber 8 described later, and is closed by an oil filler plug 22. Although one is illustrated in the drawing, two oil fillers 21 and two oil filler plugs 22 are provided on the same circumference of the cylinder 2, and supply oil from either one of them into the hydraulic chamber 8, and the other is used for air bleeding. A hydraulic pressure in the hydraulic chamber 8 may be measured by attaching a pressure sensor to any one of the oil fillers 21.

The inlet/outlet hole 23 is a through-hole for inlet/outlet of air in a pneumatic chamber 9 described later, and is connected to an inlet/outlet 24. The pneumatic chamber 9, the inlet/outlet hole 23, and the inlet/outlet 24 function as biasing means that applies a force to the fluid piston in a direction toward the input side.

The input-side lid 3 is formed in a plate shape having a large diameter flange portion and a small diameter portion. The input-side lid 3 has a small diameter portion accommodated in the cylinder 2, and an end surface of the flange portion on the output side, abutting against the open end of the cylinder 2.

Through-holes 32 are formed at eight locations in the flange portion of the input-side lid 3. As illustrated in FIG. 1B, the eight pressing bolts 33 are inserted through the through-holes 32 and screwed into the screw holes 26 of the cylinder 2, so that the input-side lid 3 is fixed to the cylinder 2.

The flange portion of the input-side lid 3 is not circular as illustrated in FIG. 1B, but is formed in a square shape having four corners cut out concentrically. Therefore, four locations of an outer circumferential surface of the flange portion of the input-side lid 3 are formed in a flat shape, and a length between the flat surfaces facing each other is larger than the diameter of the cylinder 2. The shape is the same as that of the flange portion of the output-side lid 5 described later.

Therefore, the thrust expansion device 1 can be stably mounted on a mounting table or the like by both surfaces positioned on the same surface of the input-side lid 3 and the output-side lid 5. As will be described later, if extension adaptors 142 and 162 are fixed to the side surface of the thrust expansion device 1, the extension adaptors 142 and 162 can be stably bolted to a flat surface of the flange portion by pressing bolts 143, 144, 163, and 164 (See FIGS. 5A to 6B).

Although not illustrated in the drawing, screw holes (not illustrated) for the pressing bolts for fixing the extension adaptors 142 and 162 are formed, in the radial direction, on flat surface portions of an outer circumference of the flange portion in the input-side lid 3 and the output-side lid 5.

At the center of the input-side lid 3, a through-hole 31 (replacing input portion), in which the lid adaptor 4 is disposed, is formed (see FIG. 2). The through-hole 31 of the input-side lid 3 is provided with a stepped portion by forming an inner diameter of the input side larger than that of the output side in accordance with the shape of the lid adaptor 4, and a screw hole 34 is formed in the stepped portion in an output direction.

As illustrated in FIG. 1B, screw holes 35 are formed at four locations on the end surface of the input-side lid 3 on the input side. Since the screw hole 35 does not appear in the cross sections illustrated in FIGS. 1A and 2, the screw hole 35 is illustrated in a dotted line in the drawings. The screw hole 35 is a screw hole for bolting an input cylinder device such as an air cylinder to the thrust expansion device 1.

Further, an outer circumferential groove 38 is formed over the entire circumference on the outer circumferential surface of the small diameter portion accommodated in the cylinder 2 in the input-side lid 3 (see FIG. 2), and an O-ring 39 (see FIG. 1A) is disposed in the outer circumferential groove 38. The O-ring 39 seals oil in the hydraulic chamber 8 described later.

The lid adaptor 4 is disposed in the through-hole 31 of the input-side lid 3, and the lid adaptor 4 is fixed to the input-side lid 3 by a pressing bolt 44.

A through-hole 41 (input portion) is formed at the center of the lid adaptor 4. The through-hole 41 is formed so that an inner diameter on the output side is larger than an inner diameter on the input side.

A guide bush 42 having the same thickness as a difference in inner diameter is disposed on the output side.

An outer diameter of the guide bush 42 is the same as the inner diameter of the through-hole 41 on the output side, and the inner diameter of the guide bush 42 is the same as the inner diameter of the through-hole 41 on the input side. However, the outer diameter of the guide bush 42 is formed to be larger by a press-fit interference (dimensional tolerance range) when the guide bush 42 is press-fitted into the through-hole 41. Further, the inner diameter of the guide bush 42 is larger than the outer diameter of the input rod 101 to be inserted, and the input rod 101 is formed smaller than the inner diameter of the through-hole 41 on the input side within the dimensional tolerance range, so that the input rod 101 does not come into contact with the lid adaptor 4. A length of the guide bush 42 in an axial direction is formed such that the end surface thereof on the output side is shorter than a length to the end surface of the lid adaptor 4 on the output side by the dimensional tolerance.

The guide bush 42 is a guide member that receives input rods of various cylinders attached to the thrust expansion device 1 and guides the movement of the input rod in a front-rear direction (input direction and output direction), on the inner circumferential surface.

In the flange portion of the lid adaptor 4, through-holes 43 are formed at eight locations corresponding to the pressing bolts 44 at eight locations illustrated in FIG. 1B. The pressing bolt 44 is inserted into the through-hole 43 and screwed into the screw hole 34 of the input-side lid 3, whereby the lid adaptor 4 is fixed to the input-side lid 3.

The lid adaptor 4 is appropriately replaced in accordance with the size of the cylinder device disposed on the input side, particularly the size of the input rod inserted into the through-hole 41. The inner diameters of the through-hole 41 and the guide bush 42 of the lid adaptor 4 to be replaced, and a size of an O-ring 47 described later are selected according to the input rod diameter of the cylinder device.

The replacement of the lid adaptor 4 is performed by removing the pressing bolt 44.

According to the present embodiment, by providing the lid adaptor 4 corresponding to the cylinder on the input side separately from the input-side lid 3, the cylinder can be easily replaced to different types of cylinders on the input side while the hydraulic piston 7 is accommodated inside thereof.

The input-side lid 3 and the lid adaptor 4 are not separated, but the input-side lid 3 that is integrally formed is used, is removed by the pressing bolt 33, and may be replaced to an input-side lid 3 matched to the input rod diameter of the cylinder device.

Figure 3B:
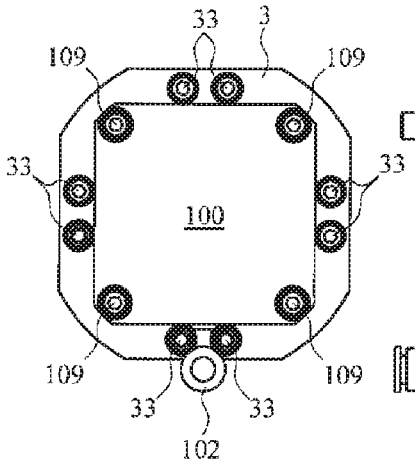
FIGS. 3A to 3D are explanatory views of first and second usage examples of the thrust expansion device.
Figure 3A:
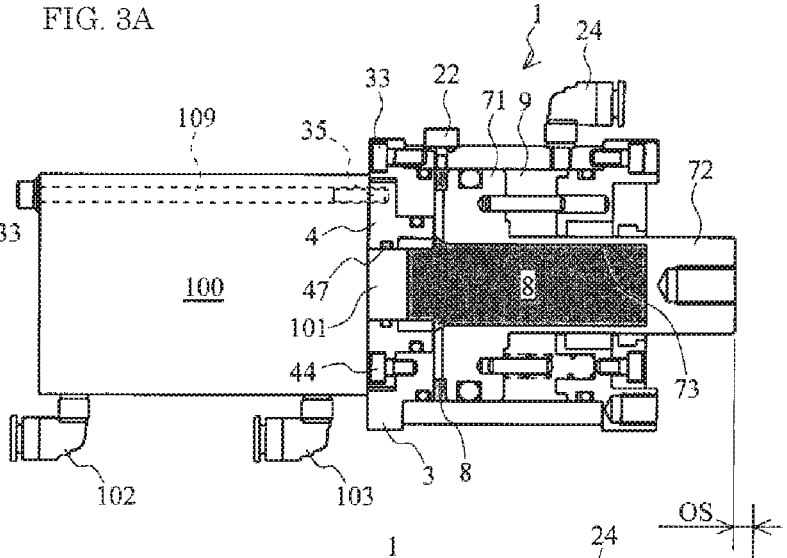
Figure 3C:
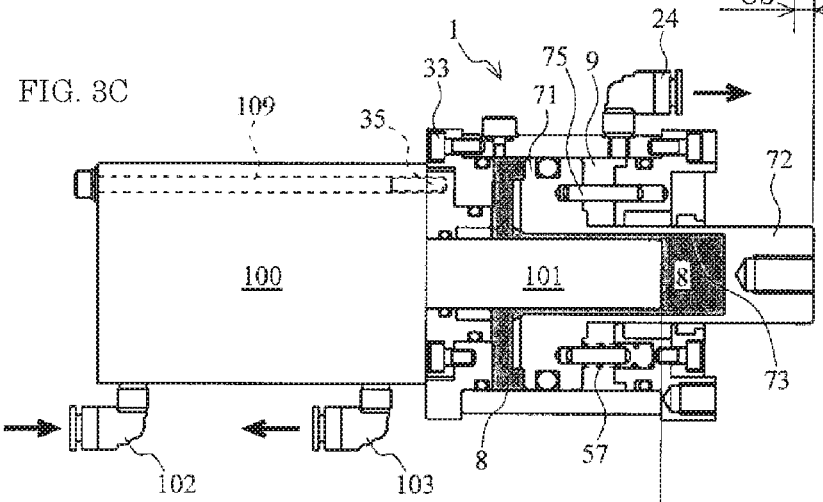
Figure 3D:
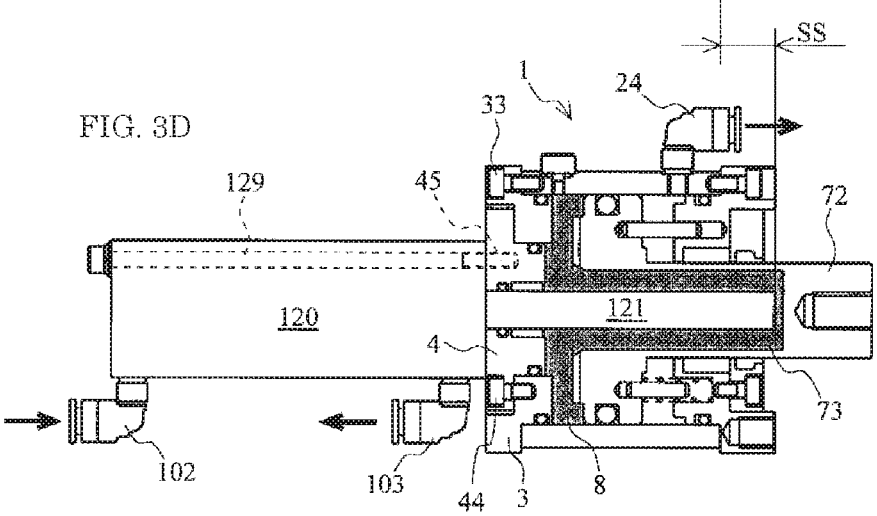

Although not illustrated in FIGS. 1A to 2, according to the lid adaptor 4, for example, as illustrated in FIG. 3D, a plurality screw holes 45 for attaching the cylinder device to the input side of the thrust expansion device 1 are formed.

An inner circumferential groove 46 is formed over the entire circumference of the inner circumferential surface of the through-hole 41 on the input side in the lid adaptor 4 (see FIG. 2), and the O-ring 47 (see FIG. 1A) is disposed in the inner circumferential groove 46.

An outer circumferential groove 48 is formed over the entire circumference of the outer circumferential surface of the small diameter portion in the lid adaptor 4 (see FIG. 2), and the O-ring 49 (see FIG. 1A) is disposed in the outer circumferential groove 48.

Both the O-ring 47 and the O-ring 49 seal oil in the hydraulic chamber described later.

On the other hand, the output-side lid 5 is disposed on the output side of the cylinder 2.

The output-side lid 5 is formed in a plate shape having a small diameter portion and a large diameter flange portion. The small diameter portion of the output-side lid 5 is accommodated in the cylinder 2, and an end surface of the flange portion on the input side abuts against the open end of the cylinder 2.

An outer circumferential groove 58 is formed on the entire circumference of the outer circumferential surface of the small diameter portion in the output-side lid 5 (see FIG. 2), and an O-ring 59 for sealing the air in the pneumatic chamber 9 is disposed in the outer circumferential groove 58 (see FIG. 1A).

Through-holes 53 are formed at six locations in the flange portion of the output-side lid 5. As illustrated in FIG. 1C, the six pressing bolts 54 are inserted into the through-holes 53 and screwed into the screw holes 25 of the cylinder 2, so that the output-side lid 5 is fixed to the cylinder 2.

The flange portion of the output-side lid 5 is formed in a square shape with four corners concentrically cut out as in the case of the input-side lid 3 (see FIGS. 1B and 1C).

As illustrated in FIG. 2, a through-hole 50 in which the stop lid 6 is disposed is formed at the center of the output-side lid 5. A small inner diameter portion, a medium inner diameter portion, and a large inner diameter portion from the input side to the output side are formed on the inner circumferential surface of the through-hole 50 of the output-side lid 5.

In the stepped portion formed by the medium inner diameter portion and the large inner diameter portion, screw holes 52 directed in the input direction are formed at six locations. The screw holes 52 are provided for fixing the stop lid 6 described later to the output-side lid 5.

A guide bush 51 having the same thickness as a difference between the small inner diameter portion and the medium inner diameter portion is disposed in the medium inner diameter portion of the through-hole 50 of the output-side lid 5. A length of the guide bush 51 in the axial direction is the same as the length of the medium inner diameter portion in the axial direction. An outer diameter and an inner diameter of the guide bush 51 are respectively the same as the inner diameter of the medium inner diameter portion and the inner diameter of the small inner diameter portion of the through-hole 50.

However, the outer diameter and inner diameter of the guide bush 51 are formed so as to have a larger outer diameter by a press-fit amount within a range of a dimensional tolerance as in the case of the guide bush 42, and the inner diameter is formed smaller within the range of the dimensional tolerance. Therefore, the inserted output rod 72 does not conic in contact with other than the guide bush 51. The length of the guide bush 51 in the axial direction is also shorter than that of the medium inner diameter portion in the range of the dimensional tolerance.

The guide bush 51 is a guide member that receives the output rod 72 of the hydraulic piston 7 disposed in the cylinder 2 on the inner circumferential surface thereof and guides the movement of the input rod in the front-rear direction (input direction and output direction).

On the outside of the medium inner diameter portion of the through-hole 50 of the output-side lid 5, a hole 55 is formed at one location and holes 57*a* are formed at six locations at positions that do not interfere with each other. The number of holes 55 and holes 57 can be set arbitrarily.

A rotation preventing pin 75 slides inside the hole 55 in the input/output direction in accordance with the movement of the hydraulic piston 7 described later.

An end portion of the coil spring 57 on the output side is inserted and is fixed into and to the hole 57*a*. The end portion of the coil spring 57 (biasing means) on the input side abuts against the end surface of the piston portion 71 on the output side.

As illustrated in FIG. 1C, the screw holes 56 are formed at six locations on the end surface of the output side lid 5 on output side. The screw hole 56 is provided for attaching various members to the thrust expansion device 1 on output side.

In the through-hole 50 in the output-side lid 5, a stop lid 6 for fixing the guide bush 51 disposed in the medium inner diameter portion is disposed in the large inner diameter portion.

A through-hole 61 into which the output rod 72 is inserted is formed at the center of the stop lid 6. An inner circumferential groove 64 is formed in the through-hole 61 over the entire circumference (see FIG. 2), and a dust seal 65 (see FIG. 1A) is disposed in the inner circumferential groove 64.

The dust seal 65 prevents foreign dust and foreign matters adhering to the output rod 72 from entering the thrust expansion device 1 when the output rod 72 slides. Through-holes 62 are formed at six locations outside the through-hole 61. As illustrated in FIG. 1C, six pressing bolts 63 are inserted into the through-holes 62 and screwed into the screw holes 52 of the output-side lid 5, so that the stop lid 6 is fixed to the output-side lid 5.

The hydraulic piston 7 includes a piston portion 71 and an output rod 72 extending from the center of the piston portion 71 in the output direction. The piston portion 71 is disposed in the cylinder 2, and together with the cylinder 2, an input side surface forms a part of the inner wall of the hydraulic chamber 8, and an output side surface forms a part of the pneumatic chamber 9.

An outer circumferential groove 78 is formed over the entire circumference of the outer circumferential surface of the piston portion 71 (see FIG. 2), and an O-ring 79 (see FIG. 1A) that seals between the hydraulic chamber 8 and the pneumatic chamber 9 is disposed in the outer circumferential groove 78.

A pin hole 74 and a pin hole 76 are formed at locations corresponding to the hole 55 and the hole 57*a* of the output-side lid 5 on the end surface of the piston portion 71 on the output side.

In the pin hole 74, one end side of the rotation preventing pin 75 is fixed by press-fitting, and the other end side is slidably inserted into the output-side lid 5. The rotation preventing pin 75 restricts the rotation of the piston portion 71 according to the movement in the input/output direction.

One end side of the guide pin 77 is fixed to the pin hole 76 by press-fitting, and the output side is inserted into the coil spring 57 from the press-fitted portion so as to guide the extension and contraction of the coil spring 57. In the present embodiment, six coil springs 57 are disposed circumferentially, but one coil spring may be provided. In this case, the output rod 72 is inserted into the inner diameter of the coil spring, the end portion of the coil spring on the input side may abut against the end surface of the piston portion 71 on the output side, and the end portion of the coil spring on the output side may abut against the end surface of the output-side lid 5 in the input side, with an appropriate positioning groove or the like.

The rotation preventing pin 75 and the coil spring 57 are an example of a rotation stop member.

A bottomed cavity portion 73 that does not penetrate in the axial direction from the input side is formed at the center of the hydraulic piston 7. An inside of the cavity portion 73 also constitutes a part of the hydraulic chamber 8, and the input rod of the cylinder connected to the thrust expansion device 1 enters and leaves the inside of the cavity portion 73.

A bolt hole 72*a* is formed on the output side of the output rod 72 of the hydraulic piston 7 from the end surface thereof in the input direction. The bolt hole 72*a* is provided, for example, for attaching various tools such as punches for punching used in a press working or the like.

Next, the use of the thrust expansion device 1 configured as described above will be described.

When the thrust expansion device 1 of the present embodiment is used, various input actuators are attached to the input side to be used.

FIGS. 3A to 3D illustrate first and second usage examples in which the air cylinder that functions as the input actuator is attached to the thrust expansion device 1. In FIGS. 3A to 3D, in order to explain an internal state of the thrust expansion device 1, it illustrates the cross section.

In the first usage example of FIG. 3A, an air cylinder 100 is illustrated in an attached state, FIG. 3B illustrates the left side, and FIG. 3C illustrates an operation state of the thrust expansion device 1 by the air cylinder 100.

As illustrated in FIG. 3A, the air cylinder 100 includes a cylindrical input rod 101 and inlet/outlet holes 102 and 103. The air cylinder 100 is configured such that the front end of the input rod 101 moves in the output direction and the input direction by supplying and exhausting air from the inlet/outlet holes 102 and 103.

In addition, as illustrated in FIG. 3B, the air cylinder 100 is formed such that an external shape of the main body portion is square, and through-holes are formed in the four corners of the main body portion so as to penetrate in the axial direction.

When the air cylinder 100 is attached, four pressing bolts 109 passed through the through-holes of the main body portion are screwed into the screw holes 35 of the input-side lid 3 in a state in which the front end of the input rod 101 is inserted into the through-hole 41 formed in the input-side lid 3 of the thrust expansion device 1, and thereby the air cylinder 100 is fixed to the thrust expansion device 1.

After the air cylinder 100 is attached, the oil filler plug 22 is removed from the cylinder 2 and oil is supplied from the oil filler 21.

In addition, in the thrust expansion device 1 of the embodiment, oil, such as hydraulic fluid which is easily available and is an incompressible fluid, is used as a fluid used for a portion which outputs the fluid as amplified fluid pressure (thrust). However, it is also possible to use a fluid gas, liquid, or gel substance as the fluid to be used. In this case, the hydraulic chamber 8 is filled with the fluid.

In FIGS. 3A to 6B, an oil-filled region is illustrated by a solid color so that a state of the hydraulic chamber 8 filled with oil can be easily understood.

When using the thrust expansion device 1 to which the air cylinder 100 is attached, the inlet/outlet 24 of the thrust expansion device 1 and the inlet/outlet hole 103 of the air cylinder 100 are opened in FIG. 3A, so that the internal air can escape.

In this state, as illustrated in FIG. 3C, air is supplied from the inlet/outlet hole 102 (indicated by a thick arrow), whereby the input rod 101 of the air cylinder 100 moves in the output direction. The internal air escapes from the inlet/outlet 24 and the inlet/outlet hole 103 as indicated by a thick arrow, and enters the hydraulic chamber 8.

Therefore, the oil in a cavity portion 73 of the output rod 72 passes through the outer circumferential side of the input rod 101 and moves between the input-side lid 3, the lid adaptor 4, and the piston portion 71. The piston portion 71 and the output rod 72 move to the output side by a hydraulic stroke OS (see FIGS. 3A and 3C).

From a front end of the output rod 72, a thrust Fp1 amplified (expanded) by the hydraulic pressure is output with respect to the thrust of the air cylinder 100, that is, a thrust Fi from a front end of the input rod 101.

Here, when an area of the front end surface of the input rod 101 is S1, and an area (area including a bottom surface of the cavity portion 73 and the same as the radial sectional area of the cylinder 2) of the piston portion 71 is S2, a force received by the piston portion 71 from the oil in the hydraulic chamber 8, that is, the thrust Fp output from the front end of the output rod 72 is expressed by the following equation (1).

$$Fp1=(Fi/S1)\times S2=Fi\times(S2/S1) \quad \text{Equation (1)}$$

According to the thrust expansion device 1 of the present embodiment, since a relationship of S1<S2 is satisfied, the output rod 72 can output the thrust Fp expanded with respect to the thrust Fi from the input rod 101.

Further, the air cylinder 100 can be easily attached to the thrust expansion device 1.

A case of returning from the state of FIG. 3C in which the expanded thrust is output from the thrust expansion device 1 to the initial state illustrated to FIG. 3A is as follows.

That is, by opening the inlet/outlet hole 102 and supplying air from the inlet/outlet hole 103, the input rod 101 of the air cylinder 100 retreats to the input side.

Therefore, in the hydraulic chamber 8, a space corresponding to a volume in which the input rod 101 was placed is restored, and the space of the through-hole 41 is also restored. In the hydraulic chamber 8, no fluid flows in and out from the outside. Therefore, the oil in the hydraulic chamber 8 flows into the restored space portion, and a negative pressure to the input side is generated in the piston portion 71. Since the atmospheric pressure is applied to the pneumatic chamber 9, the piston portion 71 moves to the input side. In this case, a biasing force of the coil spring 57 assists the movement toward the input side.

Here, in a case of returning to the initial state more reliably, air may be supplied from the inlet/outlet hole 103 and air may be supplied to the pneumatic chamber 9 from the inlet/outlet 24 of the thrust expansion device 1 that has been opened.

The rotation of the piston portion 71 can be suppressed by the rotation preventing pin 75 with respect to the movement in the output direction and the movement in the input direction. Further, since the coil spring 57 extends and contracts along the guide pin 77, it is possible to apply a biasing force to the piston portion 71 in the axial direction.

FIG. 3D illustrates an operation state (corresponding to FIG. 3C) of a second usage example.

The second usage example in FIG. 3D is an example of a case in which a small air cylinder 120 smaller than the air cylinder 100 of the first usage example is attached.

The small air cylinder 120 has a smaller external size of a main body and a smaller diameter of an input rod 121 than those of the air cylinder 100.

Since the external size of the main body is small, a pressing bolt 129 for fixing the small air cylinder 120 to the thrust expansion device 1 is not screwed into the screw hole 35 of the input-side lid 3 but is screwed into the screw hole 45 formed in the lid adaptor 4.

When initially attaching the small air cylinder 120 to the thrust expansion device 1, the through-hole 41 matched with a diameter of the input rod 121 of the small air cylinder 120 and the lid adaptor 4 of the guide bush 42 are used.

On the other hand, as illustrated in FIG. 3A, a case of replacing the air cylinder 100 attached to the thrust expansion device 1 is as follows.

That is, after removing the oil filler plug 22 and draining the oil in the hydraulic chamber 8, the air cylinder 100 is removed, and the pressing bolt 44 is removed to remove the lid adaptor 4 from the input-side lid 3.

Thereafter, the lid adaptor 4 for the small air cylinder 120 is replaced, and is fixed to the input-side lid 3 by the pressing bolt 44. Thereafter, the small air cylinder 120 is screwed into the screw hole 45 by the pressing bolt 129 and is fixed to the thrust expansion device 1. Further, the cylinder 2 is filled with the oil from the oil filler 21 and then the oil filler plug 22 is put.

As described above, in the thrust expansion device 1 of the present embodiment, another cylinder having a different input rod diameter can be easily replaced by replacing the lid adaptor 4.

A stroke of the small air cylinder 120 is longer than that of the input rod 101 of the air cylinder 100 by SS. Therefore, the input rod 121 enters the cavity portion 73 of the output rod 72 as much as the SS, but the length of the cavity portion 73 is sufficiently secured in forward so as to cope with it. Therefore, even if the air cylinder 100 is changed to the small air cylinder 120, it is not necessary to replace the output rod 72.

When an area of the piston portion 71 is the same as S2, an end surface area of the input rod 121 is S3, and the thrust of the small air cylinder 120, that is, the thrust from the front end of the input rod 121 is Fi2, the output Fp2 from the output rod 72 is expressed by the following equation (2).

$$Fp2=(Fi2/S3)\times S2=Fi2\times(S2/S3) \quad \text{Equation (2)}$$

In Equation (2) and Equation (1), when Fi1=Fi2, since S1>S3, it becomes Fp2>Fp1, and a large amplified output can be obtained for the same thrust input.

Next, a third usage example of the thrust expansion device 1 is described.

Figures 4A, 4B:
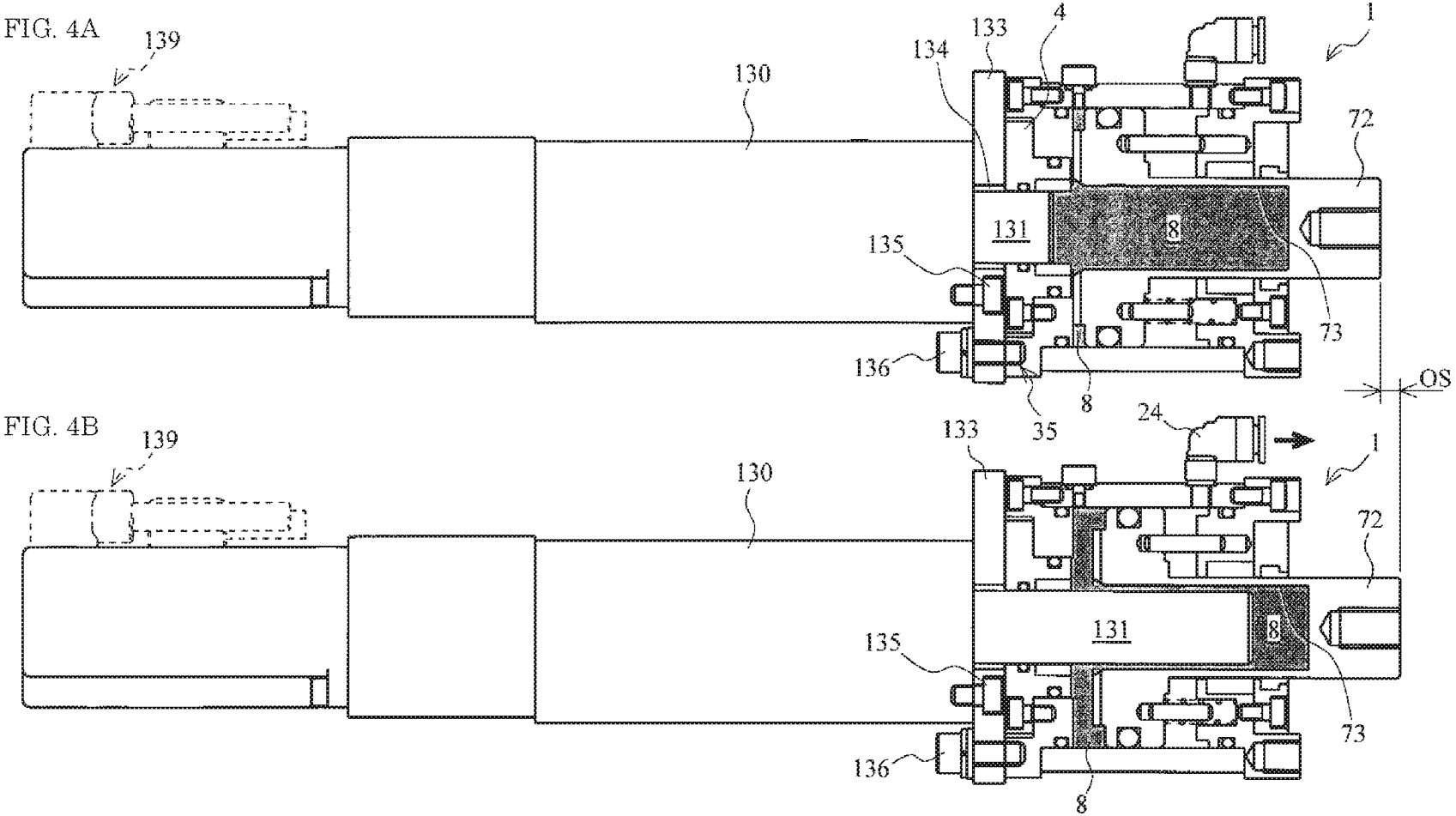
FIGS. 4A and 4B are explanatory views of a third usage example of the thrust expansion device.

FIGS. 4A and 4B illustrate a usage state for the third usage example.

The third usage example is an example of a case in which an electric cylinder 130 is attached as a cylinder attached to the thrust expansion device 1.

The electric cylinder 130 illustrated in FIG. 4A differs from the air cylinder 100 and the small air cylinder 120 described with reference to FIGS. 3A to 3D, and is an example in a case in which there is no through-hole penetrating the main body, or a case in which the positions of the screw hole 35 and the screw hole 45 do not fit.

In this case, as illustrated in FIG. 4A, the electric cylinder 130 is fixed to the thrust expansion device 1 via an adaptor 133.

Here, in a case in which the electric cylinder 130 can be directly attached to the input-side lid 3 or the lid adaptor 4, the electric cylinder 130 may be directly attached without using the adaptor 133. In FIGS. 3A to 3D, in a case in which the air cylinder cannot be directly attached to the input-side lid 3 or the lid adaptor 4, an adaptor corresponding to the adaptor 133 may be provided to fix to the thrust expansion device 1. The adaptor 133 is provided with a through-hole 134 into which a cylindrical input rod 131 is inserted at the center, a through-hole is formed corresponding to a position of the screw hole 35 of the input-side lid 3, and a through-hole is formed for fixing to the electric cylinder 130.

The input rod 131 passes through the through-hole 134 of the adaptor 133, and the electric cylinder 130 is attached to the adaptor 133 by a pressing bolt 135. Then, the electric cylinder 130 is fixed to the thrust expansion device 1 via the adaptor 133 by screwing a pressing bolt 136 into the screw hole 35 of the lid adaptor 4.

In the sectional view of FIGS. 4A and 4B, since the cross section is changed middle to display the pressing bolt 136, the display position of the screw hole 35 is different from that in FIGS. 1A to 1C, but the actual position of the screw hole 35 is formed at the same position as illustrated in FIG. 1B.

When a cylinder device having a main body of which an external shape is larger than that of the input-side lid 3 is attached, an adaptor having a diameter larger than that of the input-side lid 3 is used. After the adaptor is bolted to the input-side lid 3 (or the lid adaptor 4), the cylinder is fixed by a pressing bolt outside the adaptor from the input-side lid 3.

The electric cylinder 130 is provided with a power feeding unit 139 and controls energization of a built-in motor, so that the input rod 131 can be taken in and out.

By making the inlet/outlet 24 is in an open state and driving the electric cylinder 130 to move the input rod 131 in the output direction. Therefore, as illustrated in FIG. 4B, the input rod 131 enters the inside of the cavity portion 73 (hydraulic chamber 8), and the output rod 72 forwards by the hydraulic stroke OS and outputs the expanded thrust from the front end of the output rod 72.

In this case, the thrust output from the front end of the output rod 72 is obtained according to Equation (1). The principle of thrust expansion is the same as that of the air cylinder.

As described above, according to the thrust expansion device 1 of the present embodiment, the electric cylinder 130 can be easily attached. Therefore, for the input-side actuator, it is possible to optimally select the air drive or electric drive according to the use environment of the device.

In the present embodiment, as the input-side actuator, an air-driven actuator is illustrated in FIGS. 3A to 3D and an electrically driven actuator is illustrated in FIGS. 4A and 4B, but as long as a cylinder-type linear motion actuator having one equivalent to the input rod 131 is used, anything may be used, and as long as the input-side actuator can be attached to the thrust expansion device 1, the thrust of the input actuator can be expanded and output.

When returning from the output state illustrated in FIG. 4B to the initial state illustrated in FIG. 4A, the electric cylinder 130 may be driven to retreat the input rod 131 in the input direction.

Therefore, the piston portion 71 moves to the input side by the negative pressure due to the movement of the oil in the hydraulic chamber 8 to the input side and the biasing force of the coil spring 57.

Here, in a case of returning to the initial state more reliably, air may be supplied to the pneumatic chamber 9 from the inlet/outlet 24 of the thrust expansion device 1 that has been in the opened state.

Next, fourth and fifth usage examples of the thrust expansion device 1 will be described.

Whereas the input rod of each cylinder device described in the first to third usage examples has the cylindrical shape, a cylinder device attached to the thrust expansion device 1 in the fourth and fifth usage examples is an example of a case in which the input rod does not have a single cylindrical shape.

Many of front ends of general cylinder rods have male or female screws at the rod front end, and one or several two-surface width cuts is made on the outer circumferential surface of the input rod to hang a workpiece tool (for example, a spanner) when parts are assembled using the screws. In a case of a non-cylindrical shape such as the two-surface width cut or male screw portion, the oil in the hydraulic chamber 8 cannot be sealed with an O-ring or the like in a range where the portion slides, so that a seal portion cannot be disposed.

Even in a case of a cylindrical shape, there is a case in which the input rod has a stepped shape with a small diameter from a middle of the front end portion, but in the same manner, an O-ring cannot be provided in a range where the stepped portion slides.

It is also possible to insert the irregularly shaped portions deep inside the hydraulic chamber 8 so that they do not slide on the O-ring portion. However, in that case, it is necessary to lengthen the cavity portion 73, which not only increases the size, but also requires replacement of the output rod 72 in some cases. Moreover, when inserting the irregularly shaped portion, the O-ring may be damaged and it cannot assemble easily.

Therefore, in the following usage example, a case will be described in which the actuator having these irregularly shaped portions is configured to be easily coupled to the thrust expansion device 1.

Figures 5A, 5B:
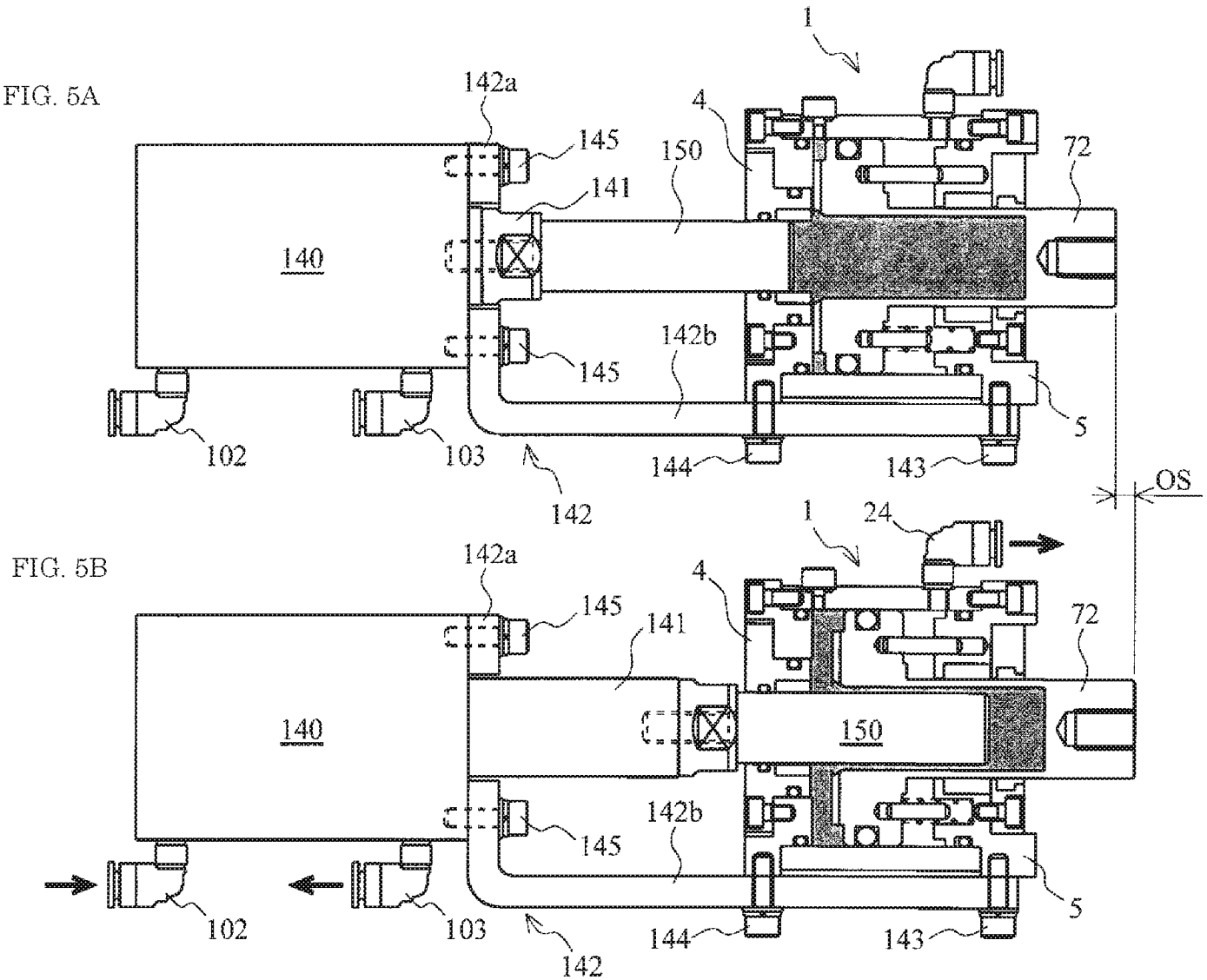
FIGS. 5A and 5B are explanatory views of a fourth usage example of the thrust expansion device.

FIGS. 5A and 5B illustrate a state in which an air cylinder 140 having the irregularly shaped portion at the front end portion of the input rod is attached to the thrust expansion device 1, as a fourth usage example.

The air cylinder 140 illustrated in FIG. 5A is provided with a square pole-shaped input rod 141 that is not circular in cross section, for example, in which the two-surface width cut portions are formed at two locations with 90° phase, and an attachment screw hole is formed at the center of the front end.

Since the air cylinder 140 cannot be directly attached to the thrust expansion device 1, the air cylinder 140 is attached by an adaptor rod 150 and an extension adaptor 142.

The adaptor rod 150 has a bolt formed at an end portion on the input side, and is screwed into a screw hole at the front end of the input rod 141. An external shape of the adaptor rod 150 is the same as the inner diameter of the lid adaptor 4 in the thrust expansion device 1.

Since the input rod 141 becomes longer as much as the adaptor rod 150 is attached, in the fourth usage example, the air cylinder 140 is attached to the thrust expansion device 1 by the extension adaptor 142.

The extension adaptor 142 includes a plate-like portion 142*a* and an extension portion 142*b* extending from the plate-like portion 142*a* in a right angle direction.

In the extension portion 142*b*, through-holes for fixing by the pressing bolts 143 and 144 are formed at positions corresponding to screw holes formed in the output-side lid 5 and the input-side lid 3 of the thrust expansion device 1.

The through-hole for the pressing bolt 143 and the screw hole of the output-side lid 5 are formed at two locations outside avoiding the interference by the pressing bolt 54 illustrated in FIG. 1C. The through-hole for the pressing bolt 144 and the screw hole of the input-side lid 3 are formed at two locations outside avoiding the interference by the pressing bolts 33 and 33 illustrated in FIG. 1B.

On the other hand, the plate-like portion 142*a* is provided with a through-hole into which the input rod 141 is inserted at a center, and concentric circular through-holes are formed at four locations on the outside thereof.

The adaptor rod 150 has a single cylindrical outer circumferential surface that is a stroke or more of the air cylinder 140, and is designed according to the shape of the input rod 141. For example, if the front end of the input rod 141 is the male screws, the adaptor rod 150 is provided with the female screws.

When attaching the air cylinder 140 to the thrust expansion device 1, the adaptor rod 150 is attached to the input rod 141, and the plate-like portion 142*a* is attached to the air cylinder 140 by the pressing bolt 145. In this state, the front end of the adaptor rod 150 is inserted into the through-hole of the lid adaptor 4, and the extension portion 142*b* is fixed to the thrust expansion device 1 by the pressing bolts 143 and 144.

Subsequent filling of the hydraulic chamber 8 with oil is the same as those in other usage examples.

The operation for outputting the expanded thrust from the output rod 72 in the operation state of FIG. 5B and the operation for returning to the initial state by the operation of driving the thrust expansion device 1, to which the air cylinder 140 is attached, are the same as those in the first usage example.

Figures 6A, 6B:
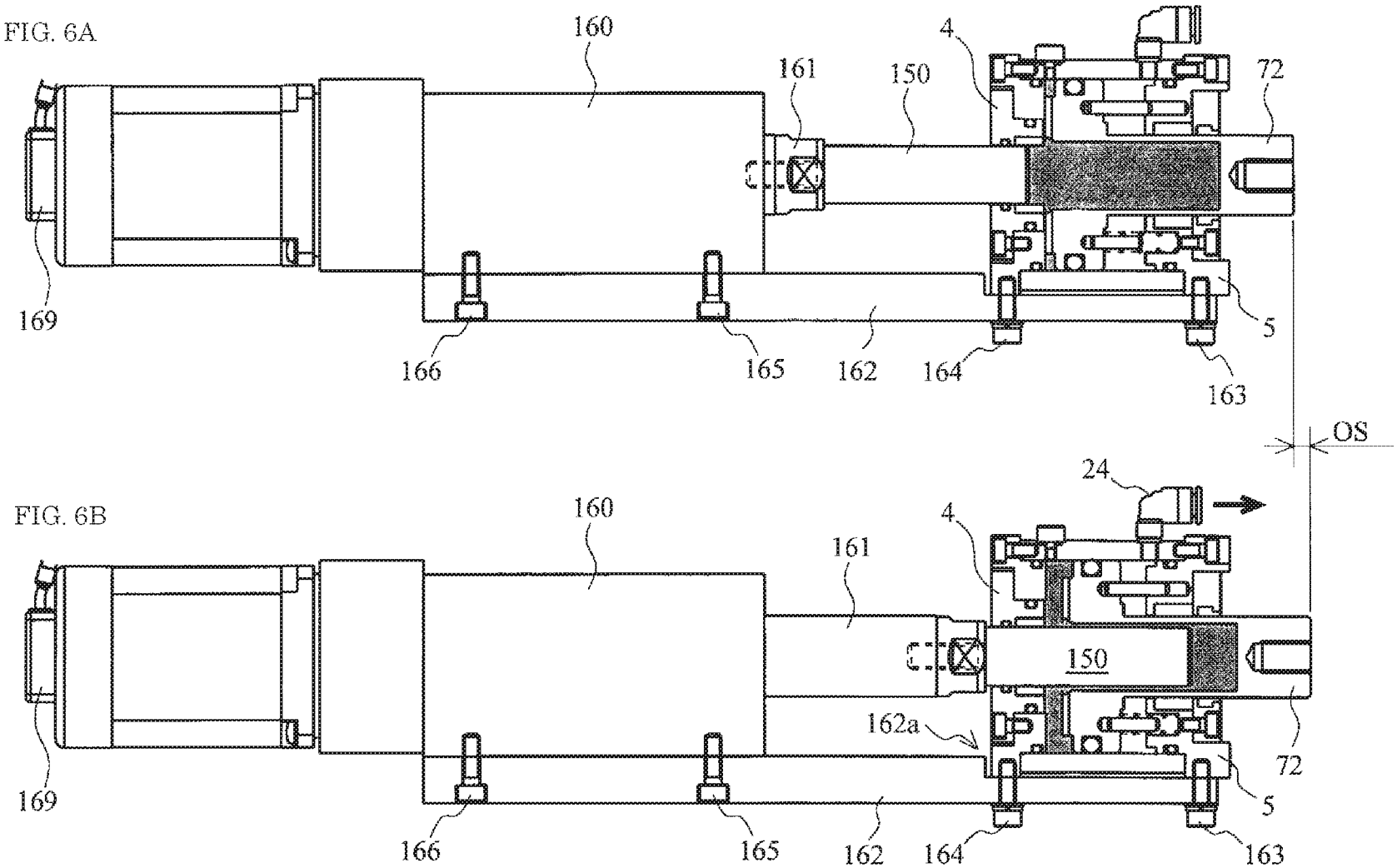
FIGS. 6A and 6B are explanatory views of a fifth usage example of the thrust expansion device.

FIGS. 6A and 6B illustrate a state in which an electric cylinder 160 is attached to the thrust expansion device 1, as a fifth usage example.

The electric cylinder 160 illustrated in FIG. 6A includes a power feeding unit 169, and a built-in motor is controlled by power feeding from the power feeding unit 169, so that the input rod 161 can be taken in and out.

The input rod 161 of the electric cylinder 160 is not circular in cross section, and has a square pole-shaped front end in which the two-surface width cut portions are formed at two locations with 90° phase on the outer circumferential surface, and an attachment screw hole is formed at the center of the front end.

Since the electric cylinder 160 cannot also be directly attached to the thrust expansion device 1 like the air cylinder 140, the electric cylinder 160 is attached by the adaptor rod 150 and the extension adaptor 162. The adaptor rod 150 is the same as that used in the fourth usage example.

Since the input rod 161 becomes long as much as the adaptor rod 150 is attached, in the fifth usage example, the electric cylinder 160 is attached to the thrust expansion device 1 by the extension adaptor 162.

The extension adaptor 162 is formed in a plate shape, and as illustrated in FIGS. 6A and 6B, a stepped portion 162*a* corresponding to a size difference in the radial direction between the thrust expansion device 1 and the electric cylinder 160 is formed. In the example illustrated in FIGS. 6A and 6B, the thrust expansion device 1 is larger, and accordingly, the output side is formed thinner than the input side by the stepped portion 162*a*.

On the output side from the stepped portion 162*a*, through-holes for fixing by the pressing bolts 163 and 164 are formed at positions corresponding to the screw holes formed in the output-side lid 5 and the input-side lid 3 of the thrust expansion device 1. The through-holes for the pressing bolts 163 and 164, and the screw holes in the output-side lid 5 and the input-side lid 3 are formed at two locations outside avoiding the interference by the pressing bolts 54 and the pressing bolts 33 illustrated in FIGS. 1C and 1B.

On the other hand, through-holes for the pressing bolts 165 and 166 are formed on the input side from the stepped portion 162*a*.

When attaching the electric cylinder 160 to the thrust expansion device 1, the adaptor rod 150 is attached to the input rod 161, and the extension adaptor 162 is attached to the electric cylinder 160 by the pressing bolts 165 and 166. In this state, the front end of the adaptor rod 150 is inserted into the through-hole of the lid adaptor 4, and the extension adaptor 162 is fixed to the thrust expansion device 1 by the pressing bolts 163 and 164.

Subsequent filling of the hydraulic chamber 8 with oil is the same as those in other usage examples.

The operation for outputting the expanded thrust from the output rod 72 in the operation state of FIG. 6B and the operation for returning to the initial state by the operation of driving the thrust expansion device 1, to which the electric cylinder 160 is attached, are the same as that in the third usage example.

Next, a sixth usage example will be described.

FIGS. 7A to 7F illustrate a state in which an air cylinder 100, an articulated robot arm 200, and an output attachment 300 are attached to the thrust expansion device 1 as the sixth usage example.

Figure 7B:
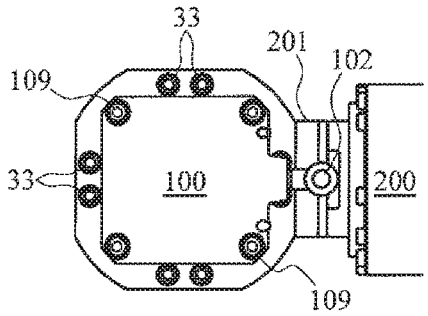
FIGS. 7A to 7F are explanatory views of a sixth usage example of the thrust expansion device.
Figure 7E:
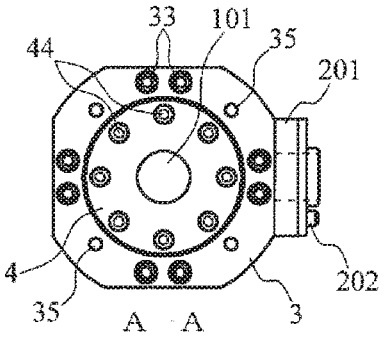
Figure 7A:
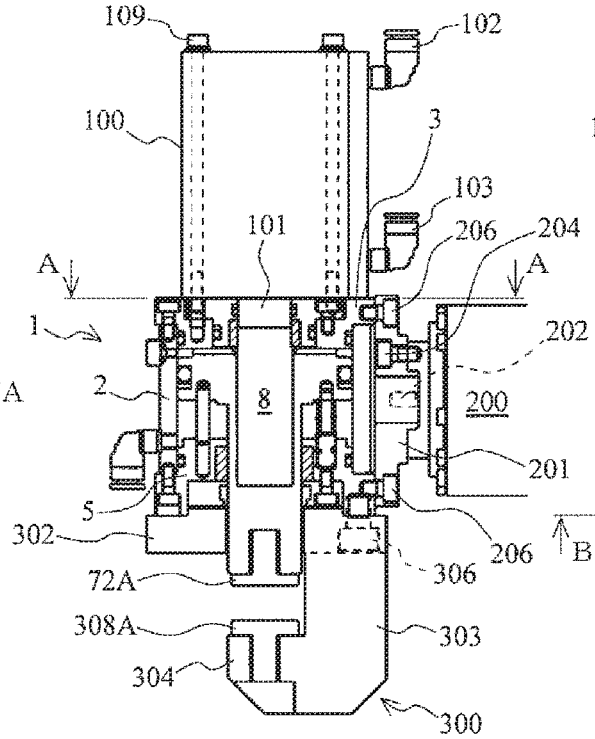
Figure 7D:
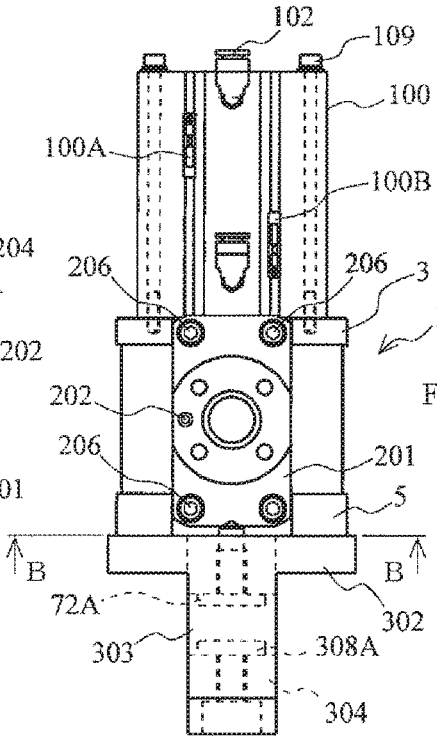
Figure 7C:
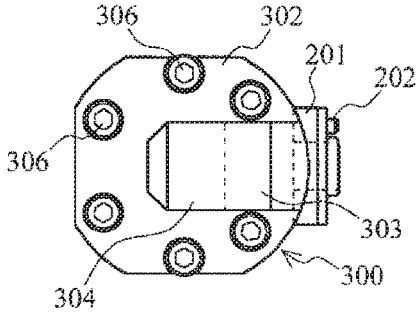
Figure 7F:
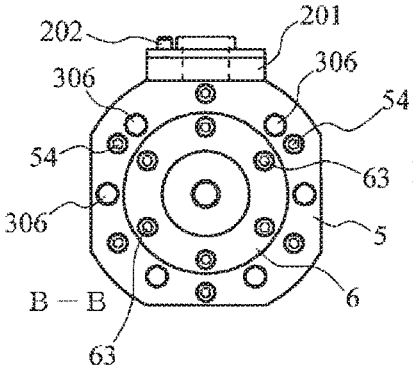

FIG. 7A illustrates a state viewed from the front of the thrust expansion device 1, FIG. 7B illustrates a state viewed from above, FIG. 7C illustrates a state viewed from below, FIG. 7D illustrates a state viewed from a side surface, FIG. 7E illustrates a cross section taken along line A-A, and FIG. 7F illustrates a cross section taken along line B-B, respectively.

In addition, FIGS. 7A and 7B illustrate a state in which the articulated robot arm 200 is attached, and the others illustrate a state in which the articulated robot arm 200 is not attached.

Further, in FIG. 7A, as in the first to fifth usage examples described in FIGS. 3A to 6B, the thrust expansion device 1 is illustrated in a cross section for explaining an internal state.

Hereinafter, in each usage example and each embodiment, the articulated robot arm 200 in an articulated robot will be described as an example. It is also possible to attach the thrust expansion device 1 to various robots such as a robot that moves only in a linear direction and a SCARA type robot that moves by rotating an arm.

In the sixth usage example, a state in which the air cylinder 100 is connected is illustrated, but the cylinder connected to the input side is not particularly limited, and any one of the cylinders described in the first to fifth usage examples can be connected.

As illustrated in FIG. 7D, the air cylinder 100 connected to the thrust expansion device 1 of the sixth usage example has two rails disposed on the outer circumferential surface of the cylinder 2 in the axial direction, an input-side sensor 100A disposed on one side, and an output-side sensor 100B disposed on the other side.

The input-side sensor 100A and the output-side sensor 100B are sensors for detecting a position of a magnet (not illustrated) disposed on the piston to which the input rod 101 (see FIGS. 3A to 3D) of the air cylinder 100 is connected.

By detecting the position of the piston of the air cylinder 100, it is possible to confirm how much the input rod 101 was inserted into the hydraulic chamber 8 of the thrust expansion device 1 and to confirm a movement distance of the output rod 72. The input-side sensor 100A and the output-side sensor 100B can be disposed in the air cylinders described in the other usage examples.

As illustrated in FIGS. 7A to 7F, when attaching the thrust expansion device 1 to the articulated robot arm 200, a robot adaptor 201 is assembled on the side surface and the thrust expansion device 1 is fixed via the robot adaptor 201.

As illustrated in FIGS. 7A and 7B, the robot adaptor 201 has a rectangular shape, and bolt holes for the pressing bolts 206 are formed at four corners thereof. The robot adaptor 201 is fixed to the input-side lid 3 and the output-side lid 5 by the pressing bolts 206.

For the bolt holes of the input-side lid 3 and the output-side lid 5 for fixing the robot adaptor 201 by the pressing bolts 206, the extension adaptors 142 and 162 described in the fourth usage example and the fifth usage example are fixed by using bolt holes for fixing the pressing bolts 143, 144, 163, and 164. However, bolt holes dedicated to the pressing bolts 206 for fixing the robot adaptor 201 may be formed in the input-side lid 3 and the output-side lid 5.

At the front end of the articulated robot arm 200, a positioning recessed portion for fixing the robot adaptor 201 and fixing bolt holes (four locations) are formed.

A positioning pin 202 for positioning the robot adaptor 201 and the articulated robot arm 200 is press-fitted on a surface of the robot adaptor 201 opposite to a side facing the thrust expansion device 1.

As illustrated in FIG. 7D, the robot adaptor 201 is formed in a rectangular shape, and has bolt holes at four locations for fixing the articulated robot arm 200 by bolts 204 on a concentric circle with the positioning pin 202.

Bolt holes for fixing to the input-side lid 3 and the output-side lid 5 of the thrust expansion device 1 by the pressing bolts 206 are formed at four corners of the robot adaptor 201.

When the thrust expansion device 1 is attached to the articulated robot arm 200, the following procedure is used.

First, the robot adaptor 201 is attached to the front end of the articulated robot arm 200 using the positioning pin 202 and is fixed by the four bolts 204.

Next, the thrust expansion device 1 is fixed to the robot adaptor 201 by the four pressing bolts 206 using the input-side lid 3 and the output-side lid 5.

On the other hand, the output attachment 300 for use in pressing, caulking, or the like is attached to the output side of the thrust expansion device 1.

As illustrated in FIGS. 7A and 7C, the output attachment 300 includes an attachment base portion 302 fixed to the output-side lid 5 of the thrust expansion device 1, an arm portion 303, and an output receiving portion 304 which are formed integrally with the attachment base portion 302.

The attachment base portion 302 is formed in a flat plate shape, and a through-hole into which the output rod 72 of the thrust expansion device 1 is inserted is formed at a center thereof. On the outer circumferential side of the through-hole, through-holes for attaching the attachment base portion 302 to the output-side lid 5 are formed at six locations, and are fixed by the pressing bolts 306.

The pressing bolts 306 for fixing the attachment base portion 302 are fixed by the screw holes 56 (see FIGS. 1A to 2) formed in the bolt hole of the output-side lid 5.

The arm portion 303 has a square pole shape, and extends in a direction orthogonal to the attachment base portion 302 at a position outside the central through-hole in the attachment base portion 302. The output receiving portion 304 is integrally formed on the front end side of the arm portion 303 so as to face the output rod 72 of the thrust expansion device 1 disposed at the center of the attachment base portion 302 in an orthogonal direction.

Similarly to the bolt hole 72*a* for attaching various tools formed at the front end of the output rod 72, a bolt hole for attaching various tools is also formed at a position facing the output receiving portion 304.

In the output attachment 300 of the example illustrated in FIGS. 7A to 7F, a caulking tool 72A and a caulking tool 308A for caulking are respectively attached to the output rod 72 and the output receiving portion 304.

Next, propagation of the pressing force output from the thrust expansion device 1 in the sixth usage example will be described.

Figure 8A:
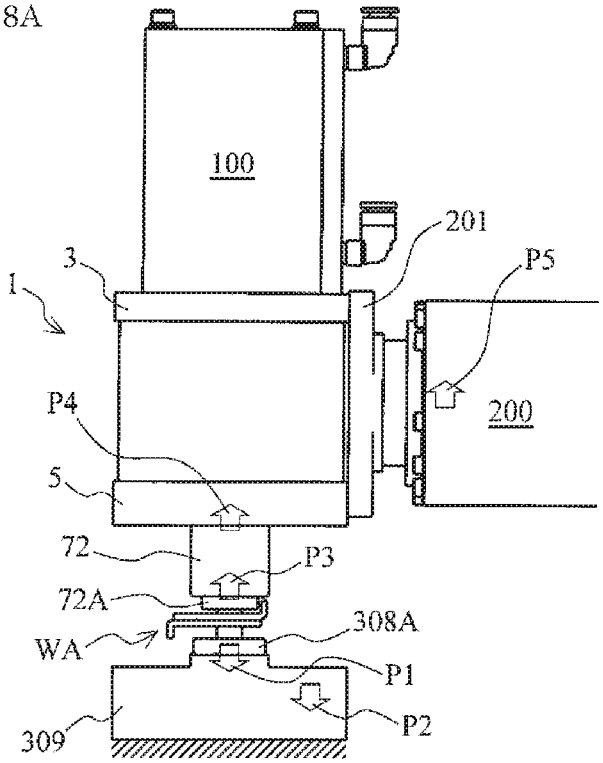
FIGS. 8A and 8B are explanatory views of propagation of a pressing force output by the thrust expansion device.
Figure 8B:
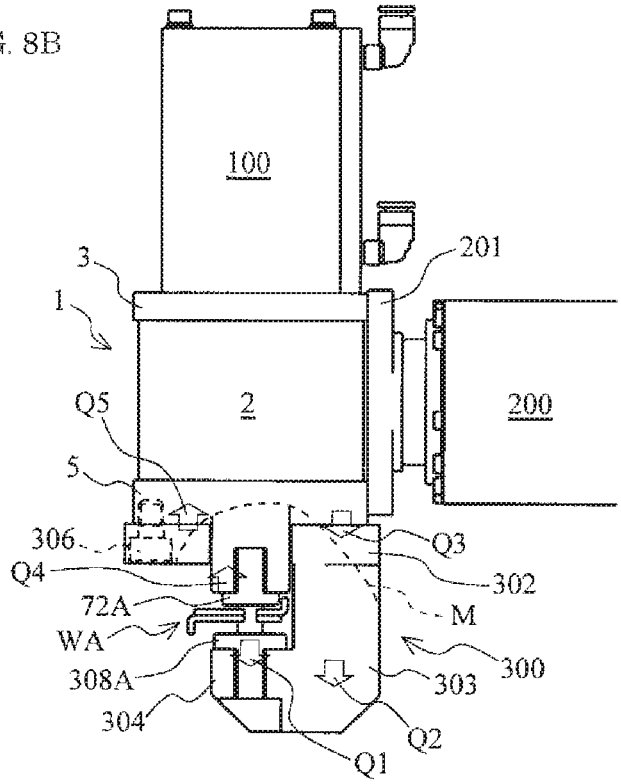

FIGS. 8A and 8B are explanatory views of the propagation of the pressing force output when a caulking process of a workpiece WA is performed by the thrust expansion device 1 attached to the articulated robot arm 200, in which FIG. 8A illustrates a case in which the output attachment 300 is not attached to the output side, and FIG. 8B illustrates a case in which the output attachment 300 is attached to the output-side lid 5. FIG. 8B illustrates the output side from a dotted line M in cross section.

The workpiece WA is the same as a workpiece WA of FIGS. 9A to 9I described later.

As illustrated in FIG. 8A, the workpiece WA is disposed on a caulking tool 308A attached to a cradle 309, and an amplified pressing force PT is output from the output rod 72 (caulking tool 72A attached to the output rod 72).

An operation of outputting the amplified pressing force P1 (=thrust Fp) from the output rod 72 is as described in FIGS. 3A and 3B.

A load (=pressing force P1) applied to the workpiece WA from the output rod 72 (caulking tool 72A) of the thrust expansion device 1 propagates to the cradle 309 as a pressing force P2, and then propagates to a grounding surface of the cradle 309.

On the other hand, the output rod 72 receives a reaction force P3 equal to the pressing force PT output to the workpiece WA, from the workpiece WA. The reaction force P3 propagates to a body (cylinder 2, input-side lid 3, and output-side lid 5) of the thrust expansion device 1 as a reaction force P4, and further, a reaction force P5 propagates to the articulated robot arm 200 via the robot adaptor 201.

As described above, in order to perform a process such as pressing, caulking, drilling (punching), or the like without attaching the output attachment 300 to the thrust expansion device 1, it is also propagated to the articulated robot arm 200. For example, when a thrust of 10 kN is output from the thrust expansion device 1, the articulated robot arm 200 is required to have a capacity (loadable weight>propagating reaction force P5+weight of the thrust expansion device 1) sufficient to receive a reaction force of propagating 10 kN.

However, the articulated robot arm 200 having a loadable weight of 10 kN or more is large in size and is not suitable for working a small workpiece from the viewpoint of equipment cost and installation space.

Next, the propagation of the pressing force when the output attachment 300 is attached to the thrust expansion device 1 described in the sixth usage example, and pressing or the like is performed will be described.

As illustrated in FIG. 8B, a load (=pressing force Q1=P1) applied to the workpiece WA from the output rod 72 (caulking tool 72A) of the thrust expansion device 1 propagates from the output receiving portion 304 of the output attachment 300 to the arm portion 303 as a pressing force Q2, and further propagates to the attachment base portion 302 (=Q3).

On the other hand, the output rod 72 receives a reaction force Q4 equal to the pressing force Q1 output to the workpiece WA, from the workpiece WA, and the reaction force Q4 propagates from the body (cylinder 2, input-side lid 3, and output-side lid 5) of the thrust expansion device 1 to the attachment base portion 302 (=Q5).

As illustrated in FIG. 8B, the pressing force Q3 and the reaction force Q5 propagated to the attachment base portion 302 of the output attachment 300 are equal in magnitude and opposite in direction, so that the pressing force Q3 and the reaction force Q5 are canceled each other inside the output attachment 300 (and the thrust expansion device 1).

As described above, even when a large thrust is output from the output rod 72 of the thrust expansion device 1, the pressing force is canceled inside including the output attachment 300 and the reaction force does not propagate to the articulated robot arm 200.

Therefore, unlike the case of FIG. 8A in which the output attachment 300 is not attached, the articulated robot only needs to consider a weight of a unit to be mounted. For example, even in an articulated robot having a loadable weight of about 4 kg (however, weight of the mounting unit including the thrust expansion device 1 is less than 4 kg), it is possible to output a thrust of 10 kN or more from the thrust expansion device 1 and perform working such as pressing, caulking, or drilling.

In the related art, in a case of mainly metal working, a working apparatus is heavy and large because it requires a large working thrust, and is fixed to be used because it cannot be easily moved. Therefore, it has been necessary to move the workpiece to the working apparatus, to process the workpiece, and to return the workpiece to an original position after working.

On the other hand, according to the working apparatus using the thrust expansion device 1 described in the sixth usage example, since the thrust expansion device 1 is small and light in weight with respect to the output, the thrust expansion device 1 is fixed to the articulated robot arm 200 and moved by the articulated robot, so that it is possible to perform various processes such as caulking and drilling. A small articulated robot with a small loadable weight can also be used. Therefore, without moving the workpieces installed on a line, the working apparatus using the output attachment 300 and the thrust expansion device 1 is moved to a workpiece installation location by the articulated robot arm 200, and working such as drilling, or caulking can be performed.

As described above, according to the sixth usage example, without moving the workpiece from a production line, it is possible to process the workpiece on the line by moving the working apparatus using the output attachment 300 and the thrust expansion device 1, and in particular, if the workpiece is large in size, the work space can be reduced and the effect can be increased.

Next, various types of working using the output attachment 300 capable of canceling the thrust to be output, in the inside, will be described.

FIGS. 9A to 9I are sectional views for explaining various types of working such as caulking, drilling, and pressing according to the sixth usage example of the thrust expansion device 1.

In the caulking, drilling, and pressing, the output attachment 300 described with reference to FIGS. 7A to 8B is used. The tools attached to the front end of the output rod 72 and the output receiving portion 304 are replaced to be used by caulking tools 72A and 308A, drilling tools 72B and 308B, and press tools 72C and 308C according to working contents.

Figure 9A:
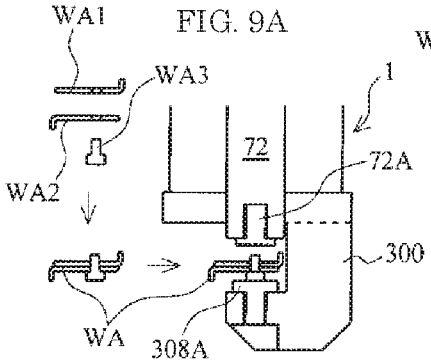
FIGS. 9A to 9I are operation explanatory views of caulking/drilling/pressing according to the sixth usage example of the thrust expansion device.
Figure 9B:
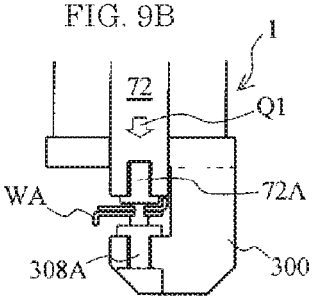
Figure 9C:
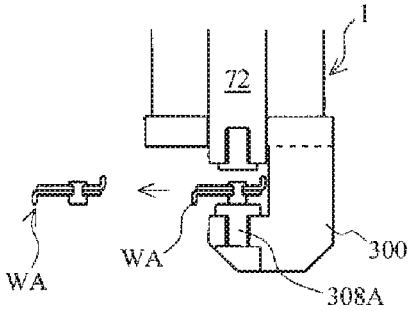

FIGS. 9A to 9C are sectional views for explaining the operation of the caulking process.

In the caulking process, as illustrated on the left side of FIG. 9A, a first workpiece WA1 and a second workpiece WA2 that are caulking objects provided with the through-holes are overlapped, and caulking WA3 is inserted into the through-holes as indicated by an arrow to prepare the workpiece WA. The workpiece WA is moved between the caulking tools 72A and 308A.

As described in the sixth usage example, the thrust expansion device 1 is attached to the articulated robot arm 200 via the robot adaptor 201, and the caulking tools 27A and 308A may be disposed at the position of the workpiece WA by the movement of the articulated robot arm 200. The same applies to drilling and pressing described later.

Thereafter, as illustrated in FIG. 9B, the air cylinder 100 (not illustrated) attached to the thrust expansion device 1 on the input side is driven as described in FIGS. 3A and 3C, the output rod 72 is forwarded in the direction of the workpiece WA, and the amplified pressing force Q1 is applied to the abutted workpiece WA to perform the caulking process of the workpiece WA.

After the caulking process is completed, the thrust expansion device 1 is returned to the initial state by operating the air cylinder 100, the workpiece WA is taken out as illustrated in FIG. 9C, and the process is finished.

Figure 9D:
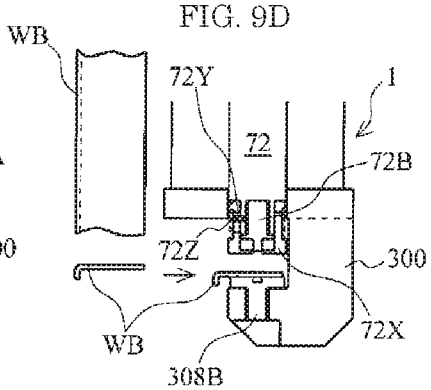
Figure 9E:
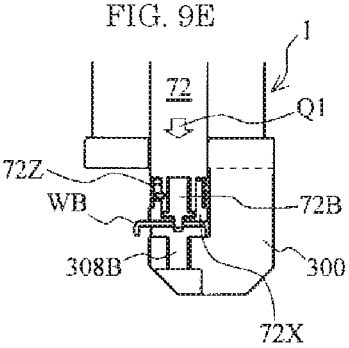
Figure 9F:
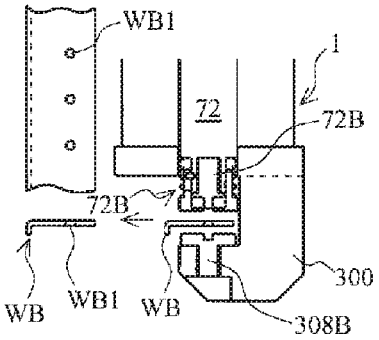

FIGS. 9D to 9F are explanatory views of an operation of the drilling process.

As illustrated in FIG. 9D, a projecting portion is formed on the drilling tool 72B and a recessed portion is formed on a drilling tool 308B according to a size and a shape of a hole to be opened.

A workpiece presser 72X is disposed so that a workpiece WB does not shift when drilling. The workpiece presser 72X is formed in a bottomed cylindrical shape in which a through-hole through which a projecting portion of the drilling tool 72B passes is formed at a center.

Since the workpiece presser 72X is formed to have a small diameter of an outer circumferential surface, a coil spring 72Z is inserted to bias the workpiece presser 72X in the output direction against the output rod 72. Therefore, as illustrated in FIG. 9D. In a state before the workpiece presser 72X abuts against the workpiece WB, a front end surface of the projecting portion formed on the drilling tool 72B is positioned inside the outer surface (front end surface) of the workpiece presser 72X.

A through-groove is formed in a body portion of the workpiece presser 72X in the axial direction, and the workpiece presser 72X biased by a coil spring 72Z is prevented from coming out of the output rod 72 by a stopper 72Y press-fitted into the output rod 72.

When performing the drilling process, as illustrated by an arrow in FIG. 9D, the prepared workpiece WB is moved between the drilling tools 72B and 308B.

Thereafter, as illustrated in FIG. 9E, the air cylinder 100 (not illustrated) attached to the thrust expansion device 1 is driven, and the output rod 72 is forwarded in the direction of the workpiece WB. The workpiece presser 72X abuts against the output rod 72 while the output rod 72 forwards, and the workpiece WB is pressed by the workpiece presser 72X by a biasing force of the coil spring 72Z as the output rod 72 forwards.

As the output rod 72 further forwards, the front end of the drilling tool 72B abuts against the workpiece WB and further penetrates, so that a desired hole is formed in the workpiece WB.

After finishing the drilling process, the thrust expansion device 1 is returned to the initial state by operating the air cylinder 100 (workpiece presser 72X is also returned to the original position by the biasing force of the coil spring), and the workpiece WB is taking out and the process is finished as illustrated in FIG. 9F.

As described above, by changing the output attachment 300 in various ways, various processes using the common thrust expansion device 1 can be performed.

Figure 9G:
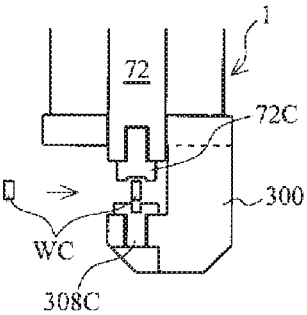
Figure 9H:
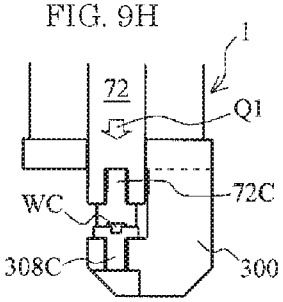
Figure 9I:
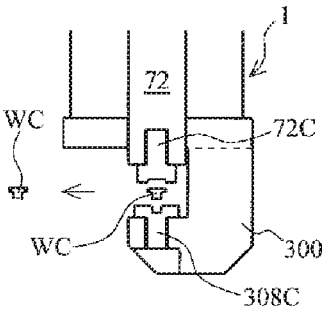

FIGS. 9G to 9I are explanatory views of operations of a press working.

As illustrated in FIG. 9G, a projecting portion is formed on the press tool 72C and a recessed portion is formed on the press tool 308C in accordance with a shape formed by the press working.

At the time of the press working, as illustrated by an arrow, a prepared workpiece WC is moved between the press tools 72C and 308C.

Thereafter, as illustrated in FIG. 9H, the air cylinder 100 (not illustrated) attached to the input side of the thrust expansion device 1 is driven to forward the output rod 72 in the direction of the workpiece WC and applies the amplified pressing force Q1 to the abutted workpiece WC. Therefore, the press working of the workpiece WC is performed.

After the press working is finished, the thrust expansion device 1 is returned to the initial state by operating the air cylinder 100, and the workpiece WC is taken out and the process is finished as illustrated in FIG. 9I.

Next, a seventh usage example of the thrust expansion device 1 will be described.

In the sixth usage example, the case in which the output attachment 300 is attached to the thrust expansion device 1 and the thrust expansion device 1 is attached to the articulated robot arm 200 via the robot adaptor 201 is described. In the sixth usage example, it is necessary to separately perform the operation of attaching the thrust expansion device 1 to the articulated robot arm 200 and the operation of attaching the output attachment 300 to the thrust expansion device 1.

Therefore, in the seventh usage example, an output attachment 350 having both the function of the robot adaptor 201 and the function of the output attachment 300 is used.

Figure 10:
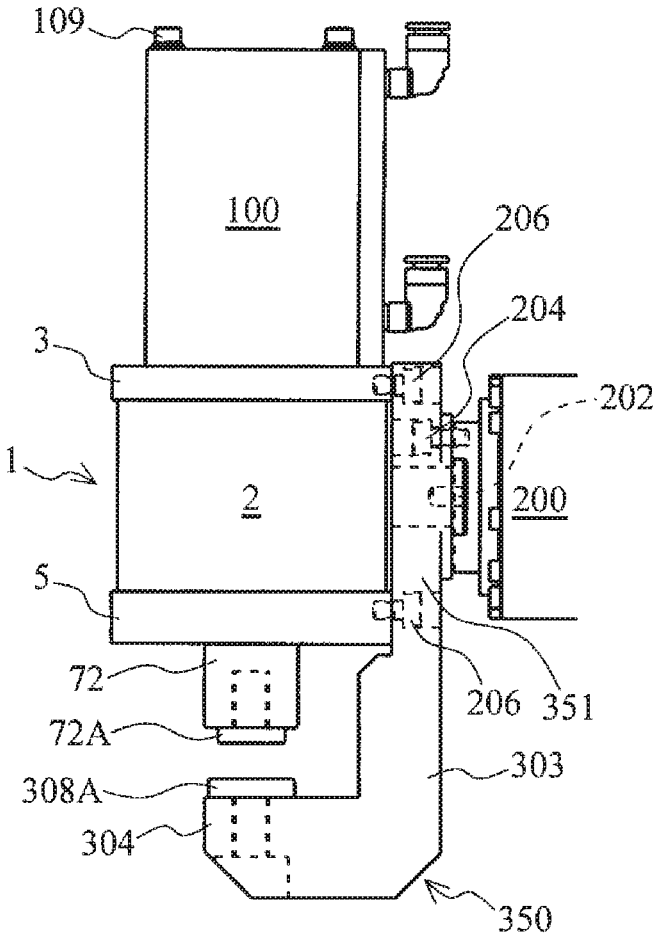
FIG. 10 is an explanatory view of a seventh usage example of the thrust expansion device.

FIG. 10 is an explanatory view of the seventh usage example of the thrust expansion device 1.

In FIG. 10, the same portions as those of the output attachment 300 and the robot adaptor 201 in the sixth usage example are denoted by the same reference numerals, and the description thereof is omitted as appropriate.

As illustrated in FIG. 10, the output attachment 350 includes an arm portion 303, and the same output receiving portion 304 as that of the sixth usage example is integrally formed at one end portion.

The other end side of the arm portion 303 is not the attachment base portion 302 but is integrally provided with a robot adaptor 351 having the same shape as that of the sixth usage example.

The robot adaptor 351 and the arm portion 303 are the same as the robot adaptor 201 and the arm portion 303 of the sixth usage example except that the robot adaptor 351 and the arm portion 303 are formed to be slightly longer than that in the sixth usage example in the axial direction in order to integrally form both.

The tools (caulking tools 72A and 308A, drilling tools 72B and 308B, and press tools 72C and 308C) attached to the output receiving portion 304 and the output rod 72 are the same as those in the sixth usage example.

In the seventh usage example, when the thrust expansion device 1 is attached to the articulated robot arm 200, the following procedure is used.

First, the robot adaptor 351 of the output attachment 350 is attached to the front end of the articulated robot arm 200 using a positioning pin 202 and is fixed by four bolts 204.

Next, the thrust expansion device 1 is fixed to the robot adaptor 351 of the output attachment 350 by four pressing bolts 206 using the input-side lid 3 and the output-side lid 5.

Thus, in the seventh usage example, since the robot adaptor 351 is integrally formed as a part of the output attachment 350, the operation is completed only by attaching the output attachment 350 to the articulated robot arm 200.

As described above, the output attachment of the present invention is configured such that working jigs such as the caulking tool 308A, the drilling tool 308B, and the press tool 308C can be replaced according to the workpiece shape to be processed and various working steps. Therefore, it is easy to handle various processes.

Next, an eighth usage example will be described.

In the eighth usage example, the air cylinder 100 is attached to the thrust expansion device 1 on the input side, and a chuck device 440 is attached to the thrust expansion device 1 on the output side (output lid 5) by a diaphragm.

Figure 11A:
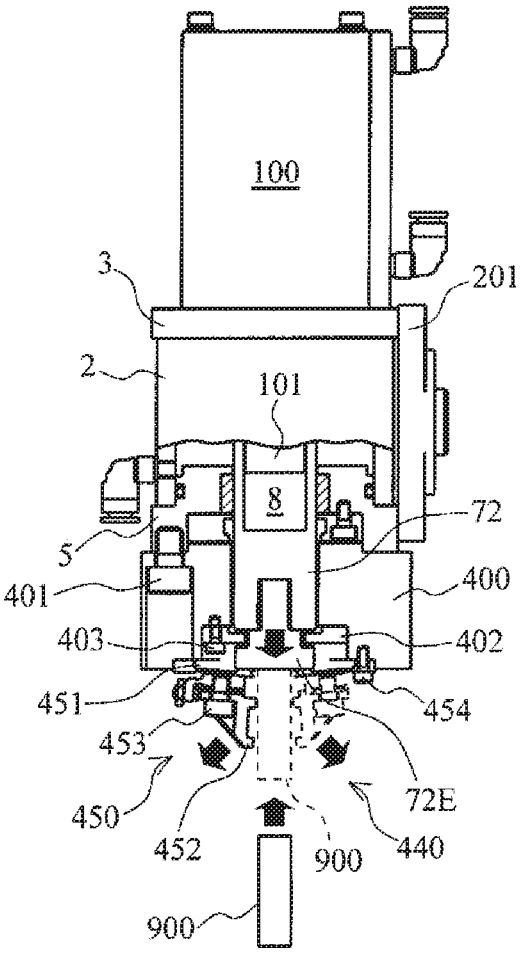
FIGS. 11A to 11D are explanatory views of an eighth usage example of the thrust expansion device.
Figure 11B:
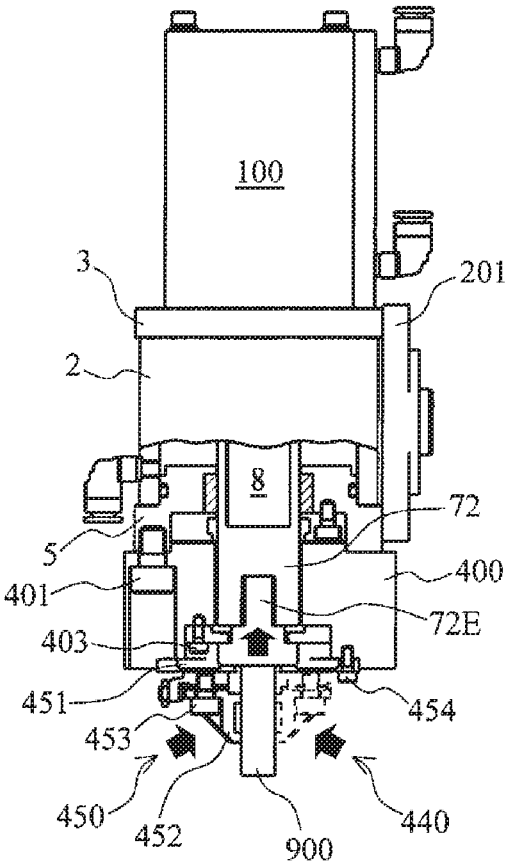

FIGS. 11A to 11D are explanatory views of the eighth usage example in which the chuck device 440 is attached to the thrust expansion device 1. FIG. 11A illustrates a state in which the chuck device 440 is opened by the thrust expansion device 1, and FIG. 11B illustrates a closed state thereof. In FIGS. 11A and 11B, the output side of the thrust expansion device 1 from a wavy line is illustrated in cross section in order to make it easy to understand a state inside the thrust expansion device 1.

Figure 11C:
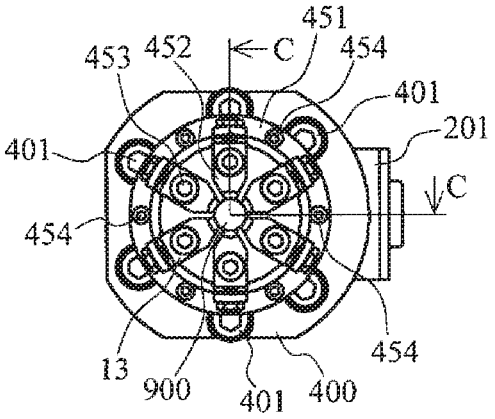

FIG. 11C is a view of the chuck device 440 of the eighth usage example as viewed from the output side, and a cross section taken along line C-C illustrated in FIG. 11C is illustrated in FIGS. 11A and 11B.

Figure 11D:
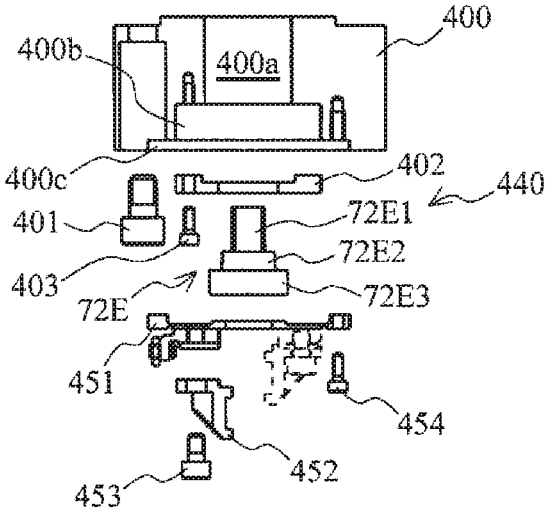

FIG. 11D is an exploded view of the chuck device of the eighth usage example.

As illustrated in FIGS. 11A to 11D, the air cylinder 100 described in the other usage examples is attached to the thrust expansion device 1 on the input side, but an electric cylinder 130 or the like can also be attached.

On the other hand, the chuck device 440 is attached to the thrust expansion device 1 on the output side via a chuck attachment 400.

The chuck attachment 400 is provided with bolt holes at six locations on an outer circumference thereof, and is fixed to the output-side lid 5 of the thrust expansion device 1 by bolts 401. The chuck attachment 400 is an example of the output attachment.

As illustrated in FIG. 11D, the chuck attachment 400 is provided with a through-hole at a center portion. The through-hole has a small inner diameter portion 400*a* of which an inner diameter is slightly larger than an outer diameter of the output rod 72, a lame inner diameter portion 400*c* of which the output side is the same size as an outer diameter of a diaphragm portion 451, and a medium inner diameter portion 400*b* having an inner diameter of a size between the small inner diameter portion 400*a* and the large inner diameter portion 400*c*.

A stopper 402 for restricting a movement distance of the output rod 72 is fixed by a bolt 403 on a bottom surface (stepped portion with the small inner diameter portion 400*a*) of the medium inner diameter portion 400*b* of the chuck attachment 400. The diaphragm portion 451 is disposed in the large inner diameter portion 400*c* and is fixed to the chuck attachment 400 by a bolt 454.

The diaphragm portion 451 includes a thin plate diaphragm that can be elastically deformed in a thickness direction, and a thick portion formed on an outer circumference of the diaphragm. The diaphragm portion 451 is fixed to the chuck attachment 400 by the bolt 403 at the thick portion, together with a claw 452 described later.

On the other hand, the output rod 72 and an opening/closing rod 72E screwed to the front end of the output rod 72 are inserted into the small inner diameter portion 400*a* of the chuck attachment 400. The output rod 72 is provided with a screw portion 72E1 on the front end side where male screws are engraved, a small diameter portion 72E2 having a larger outer diameter than the screw portion 72E1, and a flange portion 72E3 having a larger outer diameter than the small diameter portion 72E2. A stopper 402 is inserted into the small diameter portion 72E2.

A through-hole having an inner diameter larger than the outer diameter of the small diameter portion 72E2 of the opening/closing rod 72E and smaller than the outer diameter of the flange portion 72E3 is formed at a center of the stopper 402.

A chuck mechanism portion 450 includes the diaphragm portion 451 having a diaphragm which is elastically deformable in the thickness direction, and a thick portion on the outer circumference, and six claws 452 fixed radially on a surface of the diaphragm portion 451 at equal intervals in the circumferential direction. The claw 452 is fixed by a bolt 453 to the thick portion of the diaphragm portion 451.

The diaphragm of the diaphragm portion 451 is formed in a substantial disc shape and has a central hole penetrating at the center.

As described above, the diaphragm portion 451 is fixed to the chuck attachment 400 by the bolt 454 at the thick portion on the outer circumference. Therefore, the diaphragm formed in a thin portion of the diaphragm portion 451 is formed to open the chuck by being elastically deformed by pressing the vicinity of the center hole in the thickness direction in accordance with the movement, in the output direction, of the opening/closing rod 72E fixed to the front end of the output rod 72. When closing the chuck, the output rod 72 retreats, and the pressing force to the diaphragm is removed, so that the elastic deformation of the diaphragm returns to the original state and the chuck is closed.

The claw 452 fixed to the diaphragm portion 451 can be moved by the elastic deformation in opening and closing directions with respect to the central axis.

FIG. 11A illustrates a state in which the claw 452 is opened by pressing the diaphragm so that the workpiece 900 to be chucked can be inserted, and FIG. 11B illustrates a state in which the workpiece 900 inserted by closing the claw 452 by pulling back the diaphragm is chucked.

That is, as described in FIGS. 3A to 3D, the input rod 101 that has driven the air cylinder 100 is forwarded into the hydraulic chamber 8. Therefore, a pressure in the hydraulic chamber 8 is amplified, the piston portion 71 (see FIGS. 3A to 3D) and the output rod 72 also forward, and the amplified thrust from the opening/closing rod 72E at the front end of the output rod 72 is applied in the direction of pressing the diaphragm. As a result, the claw 452 is opened.

On the other hand, by inserting the workpiece 900 between the claws 452 and returning the input rod 101 of the air cylinder 100 to the input side, the pressure in the hydraulic chamber 8 also decreases, and the opening/closing rod 72E is also pulled back to the input side. The elastic deformation of the diaphragm returns to the original state and the workpiece 900 is chucked.

In general, the diaphragm chuck device is difficult to open because the pressing force required to open the chuck increases as the outer diameter decreases. The drive cylinder that is opened and closed by attaching the small chuck device is also small, and the thrust is insufficient, making it more difficult to open.

On the other hand, according to the thrust expansion device 1 of the present embodiment and the eighth usage example, the thrust capable of outputting from the output rod 72 is large even when the small chuck device 440 (about 2 inches in outer diameter) is used. Therefore, the opening amount is extremely large at ϕ0.8 mm, and a gripping force of the chuck can output 1.4 kN.

The chuck attachment 400 has a configuration in which the diaphragm portion 451 serving as gripping means for gripping the workpiece can be replaced in accordance with the workpiece shape, so that it can easily cope with workpieces of different sizes.

Next, a thrust expansion device according to a second embodiment will be described.

In the thrust expansion device 1 (hereinafter referred to as the first embodiment) described with reference to FIGS. 1A to 10, a case is described in which the air cylinder 100 or the like is attached, so that the axis of the input rod 101 of the air cylinder 100 attached to the input side coincides with the axis of the piston portion 71 and the output rod 72.

However, in the thrust expansion device 1 of the first embodiment, the entire device becomes longer in the axial direction in the connected state of the air cylinder 100.

Therefore, in thrust expansion devices 1*b* and 1 *c* of the second and third embodiments, the air cylinder 100 or the like is attached to the thrust expansion devices 1*b* and 1*c*, so that the axis of the input rod 101 disposed on the input side is orthogonal to the axis of the piston portion 71 and the output rod 72. In the embodiment, a case in which both axes are orthogonal is described, but each portion can also be disposed so as to be attached in a diagonal direction (inclination direction).

Figure 12:
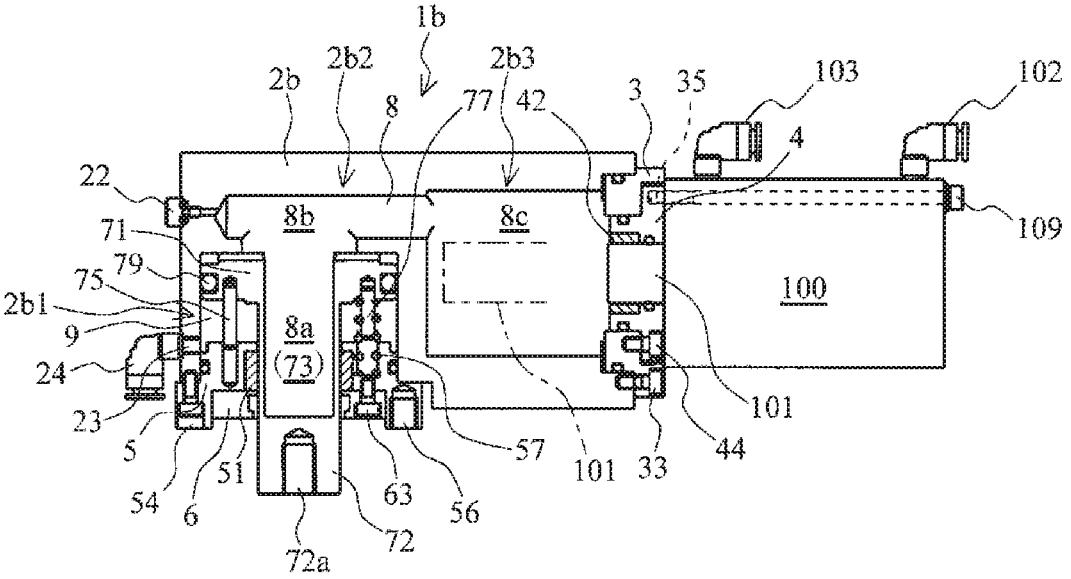
FIG. 12 is an explanatory view of a second embodiment of the thrust expansion device.

FIG. 12 illustrates a cross section of the thrust expansion device 1*b* of the second embodiment. In the thrust expansion device 1*b* of FIG. 12, a case in which the air cylinder 100 is connected to the input side is illustrated as in the first usage example (FIGS. 3A to 3C) in the first embodiment.

The same portions as those of the thrust expansion device 1 in the first embodiment are denoted by the same reference numerals, and the description thereof is omitted as appropriate. The description will focus on the different portions.

As illustrated in FIG. 12, a cylinder 2*b* of the thrust expansion device 1*b* is formed in a rectangular parallelepiped shape, and includes a cylindrical cylinder recessed portion 2*b*1 formed on one end surface, a cylindrical input recessed portion 2*b*3 formed on an end surface orthogonal to an end surface on which the cylinder recessed portion 2*b*1 is formed, and a communication portion 2*b*2 connecting the cylinder recessed portion 2*b*1 and the input recessed portion 2*b*3.

In the cylinder recessed portion 2*b*1, members on the output side from the input-side lid 3 and the lid adaptor 4 in the second embodiment, that is, the piston portion 71, the output rod 72, the output-side lid 5, the stop lid 6, the guide pin 77, the rotation preventing pin 75, and the like are disposed in the same manner as those in the first embodiment. The piston portion 71 provided in the inner circumferential surface of the cylinder recessed portion 2*b*1 and the cavity portion 73 of the output rod 72 form a hydraulic chamber 8*a*.

Similar to the first embodiment, an output-side lid 5 and the stop lid 6 are disposed on an open end of the cylinder recessed portion 2*b*1.

On the other hand, the same input-side lid 3 as that of the first embodiment is fixed to the open end of the input recessed portion 2*b*3 by a pressing bolt 33, and the lid adaptor 4 is fixed to the input-side lid 3 by a pressing bolt 44.

The air cylinder 100 is fixed to the lid adaptor 4 by a pressing bolt 109. A length (depth of the recessed portion) of the input recessed portion 2*b*3 is formed deeper than a maximum operating range of the input rod 101 of the connected air cylinder 100.

The input recessed portion 2*b*3 forms a hydraulic chamber 8*c*.

The communication portion 2*b*2 forms a hydraulic chamber 8*b* by connecting the cylinder recessed portion 2*b*1 and the input recessed portion 2*b*3.

The cylinder 2*b* is provided with an oil filler connected to the communication portion 2*b*2 to supply the oil, and is closed by the oil filler plug 22 after supplying oil into the hydraulic chambers 8*a* to 8*c*.

The oil fillers to the hydraulic chambers 8*a* to 8*c* may be formed at other positions connected to the communication portion 2*b*2, and may be formed at positions connected to the cylinder recessed portion 2*b*1 and the input recessed portion 2*b*3.

The operation when driving the thrust expansion device 1*b* of the second embodiment illustrated in FIG. 12 is the same as that of the first usage example (FIGS. 3A to 3C) of the first embodiment in which the same air cylinder is connected to the input side.

When air is supplied from the inlet/outlet hole 102 in a state in which the inlet/outlet hole 103 of the air cylinder 100 is open, the input rod 101 enters the hydraulic chamber 8*c*.

When the input rod 101 enters the hydraulic chamber 8*c* and presses the oil in the entire hydraulic chambers (8*a* to 8*c*), the piston portion 71 and the output rod 72 move in the output direction (downward in the drawing) by the hydraulic stroke OS (see FIGS. 3A and 3C). The thrust amplified by the hydraulic pressure is output from the front end of the output rod 72.

A case, in which the thrust expansion device 1*b* is returned from the state in which the expanded thrust is output to the initial state, is the same as that of the first usage example of the first embodiment.

Next, the thrust expansion device 1*c* according to a third embodiment will be described.

Figure 13:
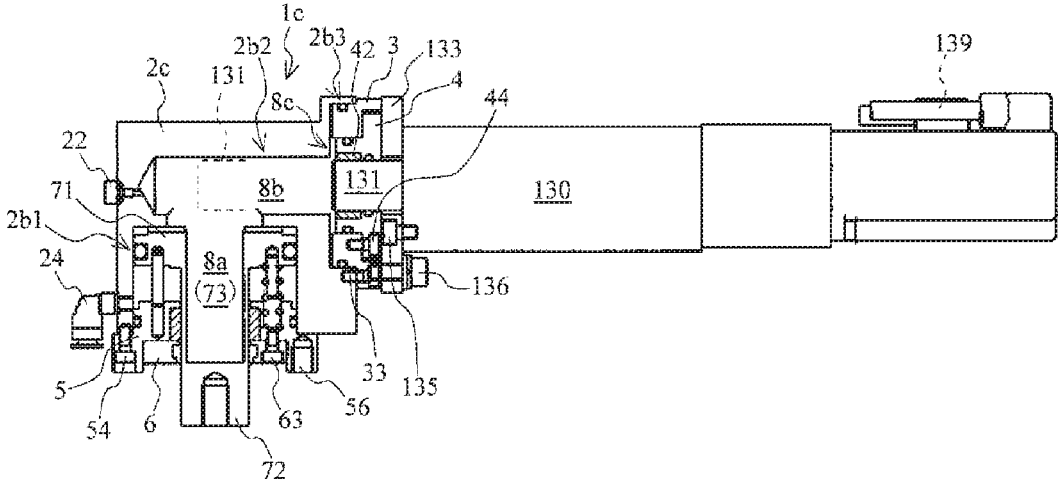
FIG. 13 is an explanatory view of a third embodiment of the thrust expansion device.

FIG. 13 illustrates a cross section of the thrust expansion device 1*c* of the third embodiment. In the thrust expansion device 1*c* of FIG. 13, similarly to the third usage example (FIGS. 4A and 4B) in the first embodiment, a case in which the electric cylinder 130 is connected to the input side is illustrated.

The same portions as those of the thrust expansion device 1 in the first embodiment are denoted by the same reference numerals, and the description thereof is omitted as appropriate. The description will focus on the different portions.

The thrust expansion device 1*b* according to the second embodiment described with reference to FIG. 12 is configured, such that the small diameter of the communication portion 2*b*2 is formed, and the axis of the input rod 101 of the air cylinder 100 to be connected is disposed on the output side of the output rod 72 from the axis of the communication portion 2*h*2. Therefore, in the thrust expansion device 1*b* of the second embodiment, the entire height (length of the output rod 72 in the output direction) of the thrust expansion device 1*b* is made smaller.

On the other hand, in the thrust expansion device 1*c* of the third embodiment, as illustrated in FIG. 13, the axis of the communication portion 2*b*2 and the axis of the input rod of the cylinder to be connected are made to coincide with each other. The inner diameter of the communication portion 2*b*2 is formed in a size such that the input rod of the cylinder connected to the input side can enter the inner diameter.

According to the thrust expansion device 1*c* of the third embodiment, the communication portion 2*b*2 can be used as in the movable range of the input rod. Therefore, an entire length of the thrust expansion device 1*c* in a lateral direction (direction which is orthogonal to the output direction of the output rod 72 and in which the input-side lid 3 is disposed) can be shortened compared to the thrust expansion device 1*b* of the second embodiment.

As illustrated in FIG. 13, in the thrust expansion device 1*c*, the communication portion 2*b*2 serving as the hydraulic chamber 8*b* is formed in the rectangular parallelepiped cylinder 2*c*, with an inner diameter into which the input rod 131 of the electric cylinder 130 can be inserted, that is, an inner diameter which is slightly larger than the diameter of the input rod 131.

The input recessed portion 2*b*3 is formed at a position at which the center of the input-side lid 3 and the lid adaptor 4 on a side on which the electric cylinder 130 is disposed coincides with the axis of the communication portion 2*b*2.

In the present embodiment, as illustrated in FIG. 13, the hydraulic chamber 8*c* is formed in the input recessed portion 2*b*3. However, since the movable range of the input rod 131 exists in the communication portion 2*b*2, the hydraulic chamber 8*c* may be eliminated. In this case, the input-side lid 3 in a state of abutting against the bottom surface of the input recessed portion 2*b*3 is fixed to the cylinder 2*c* by the pressing bolt 33.

The operation of driving the thrust expansion device is in the third embodiment configured as described above is the same as that of the thrust expansion device 1*b* of the second embodiment.

As in the first embodiment, by using various adaptors, the first to eighth usage examples can be applied to the thrust expansion devices 1*b* and 1*c* of the second and third embodiments.

Moreover, in the thrust expansion devices 1*b* and 1*c* illustrated in FIGS. 12 and 13, the cavity portion 73 is formed in the piston portion 71 and the output rod 72. However, unlike the thrust expansion device 1 of the first embodiment, since the input rod 101 of the air cylinder 100 or the like does not enter the cavity portion 73, the cavity portion 73 may not be formed.

In the second embodiment, the air cylinder (FIG. 12) and in the third embodiment, the electric cylinder (FIG. 13) are respectively used as the input-side actuators. However, the input-side actuator may be replaced with respect to each of the thrust expansion devices 1*b* and 1*c*.

In the thrust expansion devices 1*b* and 1*c* of the second and third embodiments described above, the disposition surfaces of the input-side lid 3 and the output-side lid 5 are orthogonal to the rectangular parallelepiped cylinders 2*b* and 2*c*. In the first embodiment, since the disposition surfaces of the input-side lid 3 and the output-side lid 5 are in parallel to each other, the side surfaces of the input-side lid 3 to which the robot adaptor 201 is assembled and the output-side lid 5 are also parallel to each other, but are orthogonal to each other in the second and third embodiments. When the robot adaptor 201 is assembled in the second and third embodiments, bolt holes may be disposed in accordance with the positions of the side surfaces of the input-side lid 3 and the output-side lid 5 orthogonal to each other, and may be fixed by the pressing bolts 206. Moreover, as long as an assembly strength of the robot adaptor 201 can be sufficiently secured, the robot adaptor 201 may be assembled to only one of the input-side lid 3 and the output-side lid 5 in the first to third embodiments. Further, in the thrust expansion devices 1, 1*b*, and 1*c* of the first to third embodiments, the robot adaptor 201 can be directly fixed to the cylinders 2, 2*b*, and 2*c*.

That is, fixing means for fixing the input actuator (air cylinder 100, electric cylinder 130, or the like), output fixing means for fixing the output attachment (output attachment 300, chuck attachment 400, or the like), and robot fixing means for fixing the robot adaptor 201 for attaching the articulated robot arm 200 can be disposed in at least one of the cylinder, the output-side lid portion, and the input-side lid portion.

As described above, according to the thrust expansion device 1 of the present embodiment, since it is separated and independent from the input-side actuator, a wide variety of actuators can be easily attached and replaced, and there is no need to have dedicated or integral actuator. Various inexpensive commercially available actuators can be easily attached and replaced.

It is possible to easily expand the thrust of various actuators by attaching various actuators having not only the air cylinder but also the electric type cylinder and other driving sources to the thrust expansion device 1.

Various sizes and outputs of the input-side actuator can be easily changed later, a final performance of the output rod can be easily changed, and convenience can be improved.

Further, according to the thrust expansion devices 1*b* and 1*c* in the second and third embodiments, the cylinder attaching adaptor (lid adaptor 4 or the like) is disposed so as to be in an angular direction in which the axis of the input rod in various cylinders connected to the input side is inclined with respect to the axis of the output rod 72, preferably in the right angle direction. The hydraulic chamber 8*a* that applies the hydraulic pressure to the piston portion 71 and the output rod 72, and the hydraulic chamber 8*c* that receives the pressure from the input rod of the cylinder on the input side are in communication with each other through the hydraulic chamber 8*b*.

Therefore, the length of the output rod 72 of the thrust expansion devices 1*b* and 1*c* in the output direction can be reduced. Therefore, it is possible to improve the operability when the thrust expansion devices 1*b* and 1*c* reduced in size are attached to the articulated robot arm 200 via the robot adaptor 201 described in the sixth to eighth usage examples.

What is claimed is:

1. A thrust expansion device configured to be connected to an input actuator at an input side and configured to expand and output a thrust input from the input actuator, the device comprising:

a cylinder;

a fluid piston having a piston portion disposed in the cylinder and moving in a thrust direction in the cylinder, and an output rod connected to the piston portion;

an output-side lid portion connected to one end side of the cylinder and provided with a through-hole in which the output rod moves in the thrust direction;

an input-side lid portion connected to the other end side of the cylinder and provided with an input portion to which the thrust from the input actuator is input; and an oil filler hole and an oil filler plug for supplying a fluid into a fluid chamber partitioned by the cylinder, the piston portion, and the input-side lid portion, wherein the thrust expansion device is separated and independent from the input actuator, and wherein, after the input actuator is disposed at least one location of the cylinder, the output-side lid portion, and the input-side lid portion, the fluid chamber is supplied with the fluid from the oil filler hole, then the oil filler hole is closed by the oil filler plug such that no fluid flows in and from the fluid chamber.

2. The thrust expansion device according to claim 1, wherein the input-side lid portion includes an input-side lid where a replacing input portion is formed at a center, and which is fixed to the cylinder, and a lid adaptor where the input portion is formed at a center, and which is disposed in the replacing input portion of the input-side lid, and is fixed in a replaceable manner.

3. The thrust expansion device according to claim 1, wherein the input actuator is to be disposed though the use of fixing bolt holes formed in the input-side lid portion.

4. The thrust expansion device according to claim 1, wherein the input actuator is to be disposed though the use of fixing bolt holes formed on side surfaces of the input-side lid portion and the output-side lid portion.

5. The thrust expansion device according to claim 1, wherein the fluid piston includes a bottomed cavity portion extending from the piston portion to a middle of the output rod and forming a part of the fluid chamber.

6. The thrust expansion device according to claim 1, wherein the input actuator is to be disposed at least one location of the cylinder, the output-side lid portion, and the input-side lid portion via a fixing adaptor.

7. The thrust expansion device according to claim 6, wherein the input actuator is to be disposed at a position spaced apart from the input-side lid by a predetermined distance via the fixing adaptor.

8. The thrust expansion device according to claim 7, wherein the input actuator where an adaptor rod is fixed to a front end of an input rod of the input actuator is to be disposed at a position spaced apart by the predetermined distance via the fixing adaptor.

9. The thrust expansion device according to claim 8, wherein the input portion formed on the input-side lid portion has a circular shape that matches a cross sectional shape of the adaptor rod fixed to the front end of the input actuator.

10. The thrust expansion device according to claim 1, wherein the input portion formed on the input-side lid portion has a circular shape that matches a cross sectional shape of an input rod of the input actuator.

11. The thrust expansion device according to claim 1, wherein the input actuator is an air cylinder or an electric cylinder.

12. The thrust expansion device according to claim 8, wherein the fluid chamber is configured to receive therein the input rod of the input actuator that has a circular cross-sectional shape with no level difference on an outer circumferential surface thereof.

13. The thrust expansion device according to claim 1, wherein the output-side lid portion has a rotation stop member that restricts rotation of the piston with respect to the output-side lid portion.

14. The thrust expansion device according to claim 1, further comprising:

biasing means for applying a force to the fluid piston in a direction toward the input side.

15. The thrust expansion device according to claim 1, wherein the output-side lid portion includes an output-side lid which is fixed to the cylinder, and a stop lid where the through-hole is formed at a center and which is fixed at a second through-hole formed at a center of the output-side lid in a replaceable manner.

16. The thrust expansion device according to claim 15, further comprising:

an output attachment that is disposed at least one location of the cylinder, the output-side lid portion, and the input-side lid portion, and is receiving an expanded thrust output from the output rod.

17. An assembly comprising the thrust expansion device according to claim 16 and the output attachment, wherein the output attachment is capable of replacing a working jig corresponding to a working step.

18. An assembly comprising the thrust expansion device according to claim 16 and the output attachment, wherein the output attachment is capable of replacing gripping means for gripping a workpiece according to a workpiece shape.

19. The thrust expansion device according to claim 15, further comprising:

a robot adaptor for attaching a robot arm that is disposed at least one location of the cylinder, the output-side lid portion, and the input-side lid portion.

20. The thrust expansion device according to claim 1, wherein the input actuator is to be fixed so that an axis of an input rod of the input actuator that inputs a thrust to the input portion has a predetermined inclination angle with respect to an axis of the output rod.

21. The thrust expansion device according to claim 20, wherein the input-side lid portion is connected to the cylinder at the predetermined inclination angle with respect to the output-side lid portion.

22. The thrust expansion device according to claim 20, wherein the inclination angle is 90 degrees.

23. A thrust expansion device configured to be connected to an input actuator at an input side and configured to expand and output a thrust input from the input actuator, the input actuator having a cylindrical input rod, and the thrust expansion device comprising:

a cylinder;

a fluid piston having a piston portion disposed in the cylinder and moving in a thrust direction in the cylinder, and an output rod connected to the piston portion;

an output-side lid portion connected to one end side of the cylinder and provided with a through-hole in which the output rod moves in the thrust direction;

an input-side lid portion connected to the other end side of the cylinder and provided with an input portion to which the thrust from the input actuator is input; and an oil filler hole and an oil filler plug for supplying a fluid into a fluid chamber partitioned by the cylinder, the piston portion, and the input-side lid portion, wherein the thrust expansion device is separated and independent from the input actuator, wherein the input actuator is connected by inserting the input rod through the input-side lid portion, and wherein, after the input actuator is disposed at least one location of the cylinder, the output-side lid portion, and the input-side lid portion, the fluid chamber is supplied with the fluid from the oil filler hole, then the oil filler hole is closed by the oil filler plug such that no fluid flows in and from the fluid chamber.

* * * * *